US009457562B2

(12) United States Patent
Katsumura et al.

(10) Patent No.: US 9,457,562 B2
(45) Date of Patent: Oct. 4, 2016

(54) LIQUID EJECTION DEVICE AND DUMMY JET METHOD

(71) Applicant: FUJIFILM Corporation, Tokyo (JP)

(72) Inventors: Manabu Katsumura, Kanagawa (JP); Tsuyoshi Mita, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/837,225

(22) Filed: Aug. 27, 2015

(65) Prior Publication Data

US 2015/0360464 A1 Dec. 17, 2015

Related U.S. Application Data

(63) Continuation of application No. PCT/JP2014/058123, filed on Mar. 24, 2014.

(30) Foreign Application Priority Data

Mar. 29, 2013 (JP) ..... 2013-073414
Jun. 28, 2013 (JP) ..... 2013-137026

(51) Int. Cl.
*B41J 29/38* (2006.01)
*B41J 2/045* (2006.01)
(Continued)

(52) U.S. Cl.
CPC ..... *B41J 2/0453* (2013.01); *B41J 2/14233* (2013.01); *B41J 2/16508* (2013.01);
(Continued)

(58) Field of Classification Search
CPC ..... B41J 2/04581; B41J 2/04588; B41J 2/04596; B41J 2/04541; B41J 2/0451; B41J 2202/12; B41J 2202/20; B41J 2202/21; B41J 2/045; B41J 2/0453; B41J 2/14233; B41J 2/1714
USPC ..... 347/9–12, 14, 68
See application file for complete search history.

(56) References Cited

U.S. PATENT DOCUMENTS

2005/0219315 A1 10/2005 Hori
2009/0244161 A1 10/2009 Yamamoto et al.
2010/0060690 A1* 3/2010 Hosokawa ..... B41J 2/0451 347/14

FOREIGN PATENT DOCUMENTS

JP H04-255361 A 9/1992
JP 3155762 B2 4/2001
(Continued)

OTHER PUBLICATIONS

Notification Concerning Transmittal of International Preliminary Report on Patentability (Chapter I) and Translation of Written Opinion of the International Searching Authority; PCT/JP2014/058123; issued on Oct. 8, 2015.
(Continued)

*Primary Examiner* — Jannelle M Lebron
(74) *Attorney, Agent, or Firm* — Studebaker & Brackett PC

(57) ABSTRACT

A liquid ejection device includes an ink jet head in which a plurality of nozzle portions are arranged in a matrix; a plurality of pressurizing elements that generate an ejection force; and a driving voltage supply unit that supplies a driving voltage to the pressurizing elements. In the device, the ink jet head is provided with supply flow paths, the nozzle portions which are supplied with the liquid from the same the supply flow path are divided into two or more groups, the driving voltage supply unit supplies an ejection driving voltage for ejecting the liquid to each of the groups when a dummy jet is performed, and during a period of time when the dummy jet is performed for one group, the driving voltage supply unit supplies a non-ejection driving voltage for preventing the liquid from being ejected to the other groups.

14 Claims, 34 Drawing Sheets

(51) Int. Cl.
*B41J 2/17* (2006.01)
*B41J 2/14* (2006.01)
*B41J 2/165* (2006.01)

(52) U.S. Cl.
CPC ..... *B41J2/16526* (2013.01); *B41J 2/16585* (2013.01); *B41J 2/1714* (2013.01); *B41J 2002/14459* (2013.01); *B41J 2002/1657* (2013.01); *B41J 2202/12* (2013.01); *B41J 2202/20* (2013.01); *B41J 2202/21* (2013.01)

(56) References Cited

FOREIGN PATENT DOCUMENTS

| | | | |
|---|---|---|---|
| JP | 2005-313622 | A | 11/2005 |
| JP | 2009-045803 | A | 3/2009 |
| JP | 2009-073002 | A | 4/2009 |
| JP | 2009-255542 | A | 11/2009 |
| JP | 2010-069818 | A | 4/2010 |
| JP | 2012-245758 | A | 12/2012 |

OTHER PUBLICATIONS

International Search Report for PCT/JP2014/058123 dated Jun. 10, 2014.
Written Opinion for PCT/JP2014/058123 dated Jun. 10, 2014.
An Office Action; "Notification of Reasons for Refusal" issued by the Japanese Patent Office on Jan. 28, 2016, which corresponds to Japanese Patent Application No. 2013-137026 and is related to U.S. Appl. No. 14/837,225; with English language translation.

* cited by examiner

FIG. 15

| kHz | EVALUATION OF AMOUNT OF MIST ATTACHED |
|---|---|
| 1 | BAD |
| 2 | BAD |
| 5 | BAD |
| 10 | GOOD |
| 17 | GOOD |
| 25 | GOOD |
| 29 | GOOD |

FIG. 17

| THROW DISTANCE (mm) | EVALUATION OF AMOUNT OF MIST ATTACHED |
|---|---|
| 3.4 | GOOD |
| 4.4 | GOOD |
| 5.4 | GOOD |
| 6.4 | BAD |
| 8.4 | BAD |

LIQUID EJECTION DEVICE AND DUMMY JET METHOD

CROSS-REFERENCE TO RELATED APPLICATIONS

This application is a Continuation of PCT International Application No. PCT/JP2014/058123 filed on Mar. 24, 2014, which claims priority under 35 U.S.C §119(a) to Japanese Patent Application No. 2013-073414 filed on Mar. 29, 2013, and Japanese Patent Application No. 2013-137026 filed on Jun. 28, 2013. Each of the above applications is hereby expressly incorporated by reference, in its entirety, into the present application.

BACKGROUND OF THE INVENTION

1. Field of the Invention

The present invention relates to a liquid ejection device and a dummy jet method, and more particularly, to a dummy jet for an ink jet head.

2. Description of the Related Art

In some types of ink jet head which use ink (for example, an aqueous pigment ink) using an aqueous solvent, a nozzle portion dries in the following situation and an ejection performance deteriorates.

When the nozzle portion is left unused in a standby cap portion, it is difficult to completely prevent the drying of the nozzle portion even though the standby cap portion has a moisture retention function of suppressing the drying of the nozzle portion.

When the nozzle portion is left unused above transportation means for transporting a recording medium, the nozzle portion dries while the recording medium is being moved from the transportation means to the standby cap portion even though the period for which the nozzle portion is left unused and the period for which the recording medium is moved are relatively short.

During image formation, a nozzle portion which does not eject ink or a nozzle portion which ejects a relatively small amount of ink dries.

As measures for the drying of ink in the nozzle portion, a dummy jet (preliminary ejection, idle ejection, or spitting) is performed as means for, before an ink ejection surface in which nozzle openings are formed is wiped (swept), removing ink whose viscosity has increased due to the drying of the nozzle opening and the vicinity of the nozzle opening and ink which has been attached to the edge of the nozzle opening and then semi-hardened.

For example, the dummy jet is performed for each nozzle about 20000 times to suppress a reduction in the ejection performance. However, mist is attached to the ink ejection surface by the dummy jet.

When a large amount of mist is attached to the ink ejection surface, ink which is ejected from the nozzle openings is combined with mist, which may cause a change in the ejection direction of the ejected ink, or the mist attached in the vicinity of the nozzle opening becomes hardened or semi-hardened, which may cause a change in the ejection direction of the ink ejected from the nozzle opening.

That is, the ejection of a large amount of ink in the dummy jet makes it possible to obtain the effect of suppressing the drying of ink in the nozzle portion, but causes another problem that mist is attached to the ink ejection surface.

When the number of ink ejections in the dummy jet increases, the amount of mist attached to the ink ejection surface increases. In order to remove mist attached to the ink ejection surface, it is necessary to perform a separate process, such as a wiping process, which results in an increase in a maintenance period and maintenance costs. That is, a trade-off relationship is established between the suppression of the drying of ink in the nozzle portion by the dummy jet and the attachment of mist to the ink ejection surface by the dummy jet.

In an ink jet head which ejects black ink, a water repellent film on the ink ejection surface is worn by a carbon black pigment included in the black ink due to the attachment of mist to the ink ejection surface.

When the number of wiping operations which remove the mist attached to the ink ejection surface increases, the abrasion of the ink ejection surface is accelerated by the carbon black pigment, which makes it difficult to increase the durability of a liquid repellent film on the ink ejection surface. Then, the ink jet head (a head module forming the ink jet head) is frequently replaced, which results in a reduction in the operation efficiency of the device due to the replacement of the ink jet head and an increase in costs.

JP2009-45803A discloses a technique which relates to a time-division driving method for an ink jet head (recording head) and reduces the amount of mist attached to an ink ejection surface when a dummy jet (preliminary ejection) is performed.

JP2012-245758A discloses a technique which causes a phase difference between driving pulse signals applied to a plurality of actuators corresponding to a plurality of nozzles and changes the phase difference, depending on the length of a flow path, to reduce the amount of ink discharged in a dummy jet (purging).

JP3155762B discloses a technique which makes a driving frequency during a dummy jet (idle ejection) equal to a maximum driving frequency during ink ejection.

SUMMARY OF THE INVENTION

However, in the technique disclosed in JP2009-45803A, since the time-division driving is performed during the dummy jet, ink is ejected from adjacent nozzles in a short cycle. Therefore, the ejection is affected by crosstalk and is unstable. As a result, there is a concern that mist will be generated.

In JP2012-245758A, the ejection times of the nozzles deviate from each other in one ejection cycle. Therefore, there is a concern that mist will be generated due to crosstalk which is caused by the ejection of ink from adjacent nozzles in a short cycle.

JP3155762B does not disclose the same problem as that described in the invention, such as the generation of mist during the dummy jet, and merely discloses the ejection frequency in the dummy jet.

The invention has been made in view of the above-mentioned problems and an object of the invention is to provide a liquid ejection device and a dummy jet method which perform a dummy jet capable of suppressing the attachment of mist to a liquid ejection surface.

In order to achieve the object, according to the invention, there is provided a liquid ejection device including: an ink jet head in which a plurality of nozzle portions are arranged in a matrix in a row direction and a column direction which obliquely intersects the row direction; a plurality of pressurizing elements that are provided so as to correspond to the plurality of nozzle portions and generate an ejection force for ejecting a liquid from the corresponding nozzle portions; and a driving voltage supply unit that supplies a driving voltage to the plurality of pressurizing elements. The ink jet head is provided with supply flow paths for supplying the liquid to the plurality of nozzle portions. The plurality of nozzle portions which are supplied with the liquid from the same supply flow path are divided into two or more groups. The driving voltage supply unit supplies an ejection driving voltage for ejecting the liquid to each of the groups when a dummy jet is performed. During a period of time when the dummy jet is performed for one group, the driving voltage supply unit supplies a non-ejection driving voltage for preventing the liquid from being ejected to the other groups.

According to the invention, the plurality of nozzle portions which are supplied with the liquid from the same supply flow path are divided into two or more groups. For the period for which the dummy jet is performed for one group, the non-ejection driving voltage for preventing the liquid from being ejected is supplied to the other groups. Therefore, the nozzle portions which eject the liquid are distributed. A region in which a descending air current from the liquid ejection surface is generated is widened and a region in which an ascending air current to the liquid ejection surface is generated is narrowed. The probability of mist moving to the region in which the ascending air current is generated is reduced. As a result, the amount of mist moving to the liquid ejection surface is reduced and the attachment of mist to the liquid ejection surface is suppressed.

BRIEF DESCRIPTION OF THE DRAWINGS

FIG. 15 is a table illustrating the attachment state of mist to the ink ejection surface due to a difference in ejection frequency in the dummy jet.

FIG. 17 is a table illustrating the attachment state of mist to the ink ejection surface due to a difference in throw distance in the dummy jet.

FIG. 18A is a plan view schematically illustrating an ink ejection surface indicating nozzle portions belonging to a first group; FIG. 18B is a plan view schematically illustrating an ink ejection surface indicating nozzle portions belonging to a second group; FIG. 18C is a plan view schematically illustrating an ink ejection surface indicating nozzle portions belonging to a third group; and FIG. 18D is a plan view schematically illustrating an ink ejection surface indicating nozzle portions belonging to a fourth group.

FIG. 23A illustrates a state in which an ink jet head 56 is inclined at an angle $\gamma_1$ with respect to the horizontal plane; and FIG. 23B illustrates a state in which the ink jet head 56 is inclined at an angle $\gamma_2$ ($<\gamma_1$) with respect to the horizontal plane.

FIG. 28A illustrates the state of the ink ejection surface when the number of divisions is 8; FIG. 28B illustrates the state of the ink ejection surface when there is no division; and FIG. 28C illustrates the state of the ink ejection surface when the number of divisions is 4.

FIG. 30A illustrates the state of an ink ejection surface when the number of divisions is 8; FIG. 30B illustrates the state of the ink ejection surface when there is no division; and FIG. 30C illustrates the state of the ink ejection surface when the number of divisions is 4.

DESCRIPTION OF THE PREFERRED EMBODIMENTS

Hereinafter, preferred embodiments of the invention will be described with reference to the accompanying drawings.

[Overall Structure of Ink Jet Recording Device]

Figure 1:
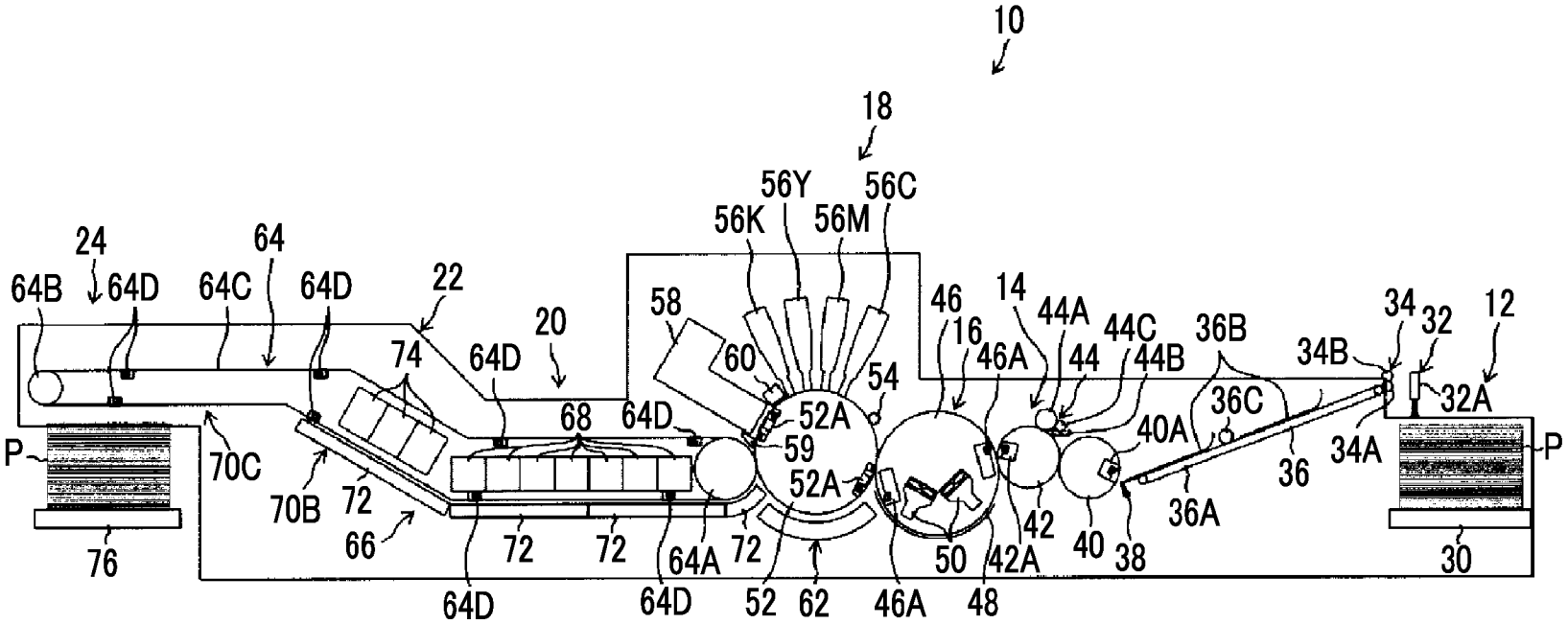
FIG. 1 is a diagram schematically illustrating the structure of an ink jet recording device according to an embodiment of the invention.

FIG. 1 is a diagram illustrating the overall structure of an ink jet recording device (liquid ejection device) to which an ink jet head (liquid ejection head) according to an embodiment of the invention is applied.

An ink jet recording device 10 illustrated in FIG. 1 is an ink jet recording device which records an image on a sheet P in an ink jet manner using an aqueous ultraviolet (UV) ink (UV curable ink using an aqueous solvent).

The ink jet recording device 10 includes a sheet feed unit 12, a process liquid applying unit 14, a process liquid drying processing unit 16, an image forming unit 18, an ink drying processing unit 20, a UV irradiation processing unit 22, and a sheet discharge unit 24. The sheet feed unit 12 feeds the sheet P. The process liquid applying unit 14 applies a process liquid to the surface of the sheet P fed from the sheet feed unit 12. The process liquid drying processing unit 16 performs a process of drying the sheet P to which the process liquid has been applied by the process liquid applying unit 14. The image forming unit 18 records an image on the sheet P dried by the process liquid drying processing unit 16 in the ink jet manner, using the aqueous UV ink. The ink drying processing unit 20 performs a process of drying the sheet P on which the image has been recorded by the image forming unit 18. The UV irradiation processing unit 22 irradiates the sheet P dried by the ink drying processing unit 20 with UV rays (active rays) to fix the image. The sheet discharge unit 24 discharges the sheet P which has been irradiated with the UV light by the UV irradiation processing unit 22.

<Sheet Feed Unit>

The sheet feed unit 12 includes a sheet feed tray 30, a sucker device 32, a sheet feed roller pair 34, a feeder board 36, a front lay 38, and a sheet feed drum 40. The sheet feed unit 12 feeds the sheets P stacked on the sheet feed tray 30 one by one to the process liquid applying unit 14.

The sheets P stacked on the sheet feed tray 30 are sequentially drawn up one by one by the sucker device 32 (suction fit 32A) and are fed to the sheet feed roller pair 34 (a pair of upper and lower rollers 34A and 34B).

The sheet P fed to the sheet feed roller pair 34 is transported forward by the pair of upper and lower rollers 34A and 34B and is then put on the feeder board 36. The sheet P put on the feeder board 36 is transported by a tape feeder 36A which is provided on a transportation surface of the feeder board 36.

Then, during the transportation process, the sheet P is pressed against the transportation surface of the feeder board 36 by a retainer 36B and a guide roller 36C such that the unevenness of the sheet P is corrected. The leading end of the sheet P transported by the feeder board 36 comes into contact with the front lay 38 such that the inclination of the sheet P is corrected. Then, the sheet P is transported to the sheet feed drum 40. Then, the leading end of the sheet P is held by a gripper 40A of the sheet feed drum 40 and the sheet P is transported to the process liquid applying unit 14.

<Process Liquid Applying Unit>

The process liquid applying unit 14 includes a process liquid applying drum 42 which transports the sheet P and a process liquid applying unit 44 that applies a predetermined process liquid to the surface of the sheet P transported by the process liquid applying drum 42. The process liquid applying unit 14 applies (coats) the process liquid to the surface of the sheet P.

The process liquid applied to the surface of the sheet P has a function of aggregating a coloring material in the aqueous UV ink which is discharged to the sheet P by the image forming unit 18 in the later stage. The discharge of the aqueous UV ink to the sheet P having the process liquid applied to the surface thereof makes it possible to perform high-quality printing, without causing landing interference, even when a general-purpose print sheet is used.

The sheet P transported from the sheet feed drum 40 of the sheet feed unit 12 is transported to the process liquid applying drum 42. The process liquid applying drum 42 is rotated, with the gripper 42A holding (grasping) the leading end of the sheet P, such that the sheet P is wound around the process liquid applying drum 42 and transports the sheet P.

During the transportation process, a coating roller 44A, to which a constant amount of process liquid measured by an anilox roller 44C has been applied from a process liquid pan 44B, comes into pressure contact with the surface of the sheet P and the process liquid is applied to the surface of the sheet P. A method of applying the process liquid is not limited to the roller application. For example, other methods, such as an ink jet method and an application method using a blade, can be used.

<Process Liquid Drying Processing Unit>

The process liquid drying processing unit 16 includes a process liquid drying processing drum 46 which transports the sheet P, a sheet transportation guide 48 which supports (guides) the rear surface of the sheet P, and a process liquid drying unit 50 which blows hot air to the surface of the sheet P transported by the process liquid drying processing drum 46 to dry the sheet P. The process liquid drying processing unit 16 performs a drying processing for the sheet P having the process liquid applied to the surface thereof.

The leading end of the sheet P, which has been transported from the process liquid applying drum 42 of the process liquid applying unit 14 to the process liquid drying processing drum 46, is held by a gripper 46A of the process liquid drying processing drum 46.

The rear surface of the sheet P is supported by the sheet transportation guide 48, with the front surface (the surface to which the process liquid has been applied) facing inward. In this state, the process liquid drying processing drum 46 is rotated to transport the sheet P.

When the sheet P is being transported by the process liquid drying processing drum 46, hot air is blown from the process liquid drying unit 50 which is provided inside the process liquid drying processing drum 46 to the surface of the sheet P to dry the sheet P. Then, a solvent component in the process liquid is removed and an ink aggregation layer is formed on the surface of the sheet P.

<Image Forming Unit>

The image forming unit 18 includes an image forming drum 52, a sheet pressing roller 54, ink jet heads 56C, 56M, 56Y, and 56K, an in-line sensor 58, a mist filter 60, and a drum cooling unit 62. The image forming drum 52 transports the sheet P. The sheet pressing roller 54 presses the sheet P transported by the image forming drum 52 to bring the sheet P into close contact with the circumferential surface of the image forming drum 52. The ink jet heads 56C, 56M, 56Y, and 56K eject ink droplets of each color, that is, C, M, Y, and K to the sheet P. The in-line sensor 58 reads the image recorded on the sheet P. The mist filter 60 captures ink mist. The image forming unit 18 discharges ink droplets (aqueous UV ink droplets) of each color, that is, C, M, Y, and K to the surface of the sheet P having the process liquid layer formed thereon to form a color image on the surface of the sheet P.

The ink jet head applied to this example may be a line head in which nozzles are formed over a length corresponding to the overall width of the sheet P (the overall length of the sheet P in a main scanning direction perpendicular to the transportation direction of the sheet P) or a short serial head which has a size shorter than the overall width of the sheet P.

The leading end of the sheet P, which has been transported from the process liquid drying processing drum 46 of the process liquid drying processing unit 16 to the image forming drum 52, is held by a gripper 52A of the image forming drum 52. In addition, the sheet P passes below the sheet pressing roller 54 and comes into close contact with the circumferential surface of the image forming drum 52.

The sheet P which comes into close contact with the circumferential surface of the image forming drum 52 is sucked by a negative pressure generated by suction holes which are formed in the circumferential surface of the image forming drum 52 and is held on the circumferential surface of the image forming drum 52.

When the sheet P which is transported while being sucked and held on the circumferential surface of the image forming drum 52 passes through ink discharge regions immediately below the ink jet heads 56C, 56M, 56Y, and 56K, the ink jet heads 56C, 56M, 56Y, and 56K discharge ink droplets of each color, that is, C, M, Y, and K to the surface of the sheet P to form a color image on the sheet P.

The ink discharged to the surface of the sheet P reacts with the ink aggregation layer formed on the surface of the sheet P and is fixed on the surface of the sheet P, without causing, for example, feathering and bleeding. Therefore, a high-quality image is formed on the surface of the sheet P.

When the sheet P having the image formed by the ink jet heads 56C, 56M, 56Y, and 56K passes through a reading region of the in-line sensor 58, the image formed on the surface of the sheet P is read.

The image is read by the in-line sensor 58 if necessary. An image defect (image abnormality), such as an ejection failure or concentration unevenness, is detected from data read from the image. When the sheet P passes through the reading region of the in-line sensor 58, the suction of the sheet P is released. Then, the sheet P passes below a guide 59 and is then transported to the ink drying processing unit 20.

<Ink Drying Processing Unit>

The ink drying processing unit 20 includes an ink drying unit 68 that dries the sheet P transported by a chain gripper 64 and performs a drying process for the sheet P having the image formed thereon to remove a liquid component remaining on the surface of the sheet P.

An example of the structure of the ink drying unit 68 includes a heat source, such as a halogen heater or an infrared (IR) heater, and a fan which blows air (gas or fluid) heated by the heat source to the sheet P.

The leading end of the sheet P, which has been transported from the image forming drum 52 of the image forming unit 18 to the chain gripper 64, is held by a gripper 64D provided in the chain gripper 64.

The chain gripper 64 has a structure in which a pair of endless chains 64C are wound around a first sprocket 64A and a second sprocket 64B.

The rear surface of the rear end of the sheet P is sucked and held by a sheet holding surface of a guide plate 72 which is arranged at a predetermined distance from the chain gripper 64.

<UV Irradiation Processing Unit>

The UV irradiation processing unit 22 includes a UV irradiation unit 74. The UV irradiation processing unit 22 irradiates the image which is recorded using the aqueous UV ink with ultraviolet rays to fix the image on the surface of the sheet P.

An example of the structure of the UV irradiation unit includes an ultraviolet light source which generates UV light and an optical system which functions as means for focusing UV light and means for deflecting UV light.

When the sheet P transported by the chain gripper 64 reaches a UV light irradiation region of the UV irradiation unit 74, the UV irradiation unit 74 provided in the chain gripper 64 performs a UV irradiation process for the sheet P.

That is, the sheet P which is transported by the chain gripper 64 while the leading end is held by the gripper and the rear surface of the rear end is sucked and held by the guide plate 72 is irradiated with UV light by the UV irradiation unit 74 that is provided at a position corresponding to the surface of the sheet P in a transportation path for the sheet P. A curing reaction occurs in the image (ink) irradiated with the UV light and the image is fixed to the surface of the sheet P.

The sheet P subjected to the UV irradiation process is transported to the sheet discharge unit 24 through an inclined transportation path 70B. The UV irradiation processing unit 22 may include a cooling processing unit which performs a cooling process for the sheet P that passes through the inclined transportation path 70B.

<Sheet Discharge Unit>

The sheet discharge unit 24 which collects the sheet P subjected to a series of image forming processes includes a sheet discharge tray 76 which collects a stack of the sheets P.

The chain gripper 64 (gripper 64D) releases the sheet P on the sheet discharge tray 76 and stacks the sheet P on the sheet discharge tray 76. The sheet discharge tray 76 collects a stack of the sheets P released from the chain gripper 64. The sheet discharge tray 76 is provided with sheet guides (not illustrated) (for example, a front sheet guide, a rear sheet guide, and a side sheet guide) in order to arrange and stack the sheets P.

The sheet discharge tray 76 is provided so as to be moved up and down by a sheet discharge tray lifting device (not illustrated). The driving of the sheet discharge tray lifting device is controlled in operative association with an increase or decrease in the number of sheets P stacked on the sheet discharge tray 76 and the sheet discharge tray lifting device moves the sheet discharge tray 76 up and down such that the uppermost sheet P is located at a constant height.

The ink jet recording device 10 illustrated in FIG. 1 includes a maintenance unit (represented by reference numeral 90 in FIG. 7) which performs a maintenance process for the ink jet heads 56C, 56M, 56Y, and 56K, which will be described in detail below.

Examples of the maintenance of the ink jet head include a dummy jet, wiping, pressure purging, and suction. In the dummy jet, a piezoelectric element (represented by reference numeral 230 in FIG. 6) is operated to eject ink from each nozzle opening (represented by reference numerals 280A and 280B in FIG. 5). An ink ejection surface (represented by reference numeral 227 in FIG. 3, a liquid ejection surface) is swept by wiping. The internal pressure of the ink jet heads 56C, 56M, 56Y, and 56K is increased by pressure purging to discharge ink from all of the nozzle openings. Ink is drawn from the ink ejection surface into a nozzle portion by suction.

<Description of Control System>

Figure 2:
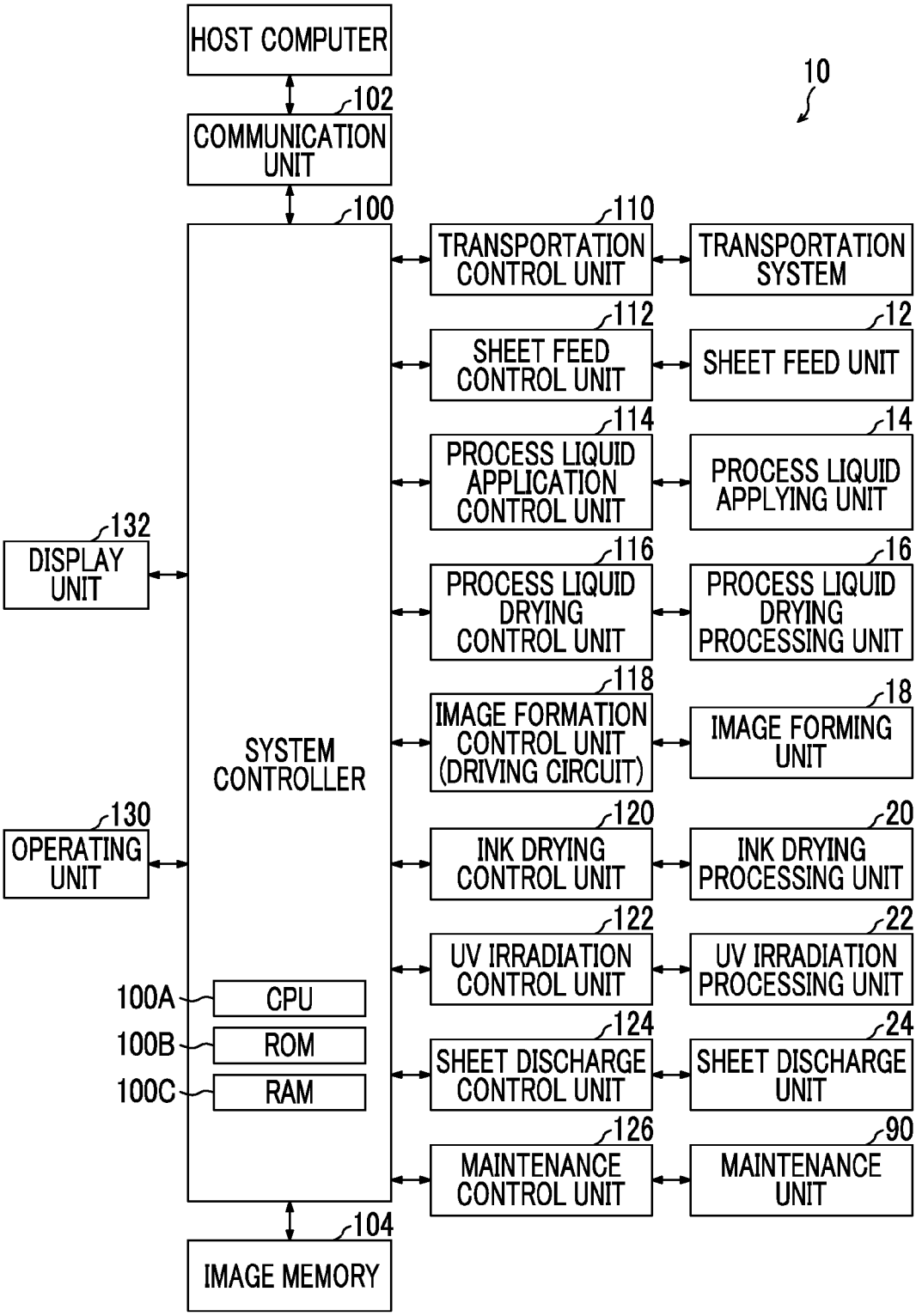
FIG. 2 is a block diagram schematically illustrating the structure of a control system.

FIG. 2 is a block diagram schematically illustrating the structure of a control system of the ink jet recording device 10 illustrated in FIG. 1.

As illustrated in FIG. 2, the ink jet recording device 10 includes, for example, a system controller 100, a communication unit 102, an image memory 104, a transportation control unit 110, a sheet feed control unit 112, a process liquid application control unit 114, a process liquid drying control unit 116, an image forming control unit 118, an ink drying control unit 120, a UV irradiation control unit 122, a sheet discharge control unit 124, a maintenance control unit 126, an operating unit 130, and a display unit 132.

The system controller 100 functions as control means for controlling the overall operation of each unit of the ink jet recording device 10 and also functions as arithmetic means for performing various types of arithmetic processing. The system controller 100 includes a central processing unit (CPU) 100A, a read only memory (ROM) 100B, and a random access memory (RAM) 100C.

The system controller 100 also functions as a memory controller which controls the writing of data to memories, such as the ROM 100B, the RAM 100C, and the image memory 104, and the reading of data from the memories.

FIG. 2 illustrates an aspect in which the memories, such as the ROM 100B and the RAM 100C, are provided in the system controller 100. However, the memories, such as the ROM 100B and the RAM 100C, may be provided outside the system controller 100.

The communication unit 102 includes a necessary communication interface and transmits and receives data to and from a host computer which is connected to the communication interface.

The image memory 104 functions as temporary storage means for storing various kinds of data including image data. The data is read from and written to the image memory 104 through the system controller 100. The image data which is received from the host computer through the communication unit 102 is temporarily stored in the image memory 104.

The transportation control unit 110 controls the operation of a transportation system for the sheet P in the ink jet recording device 10 (the transportation of the sheet P from the sheet feed unit 12 to the sheet discharge unit 24). The transportation system includes the sheet feed drum 40 in the sheet feed unit 12 illustrated in FIG. 1, the process liquid applying drum 42 in the process liquid applying unit 14, the process liquid drying processing drum 46 in the process liquid drying processing unit 16, the image forming drum 52 in the image forming unit 18, and the chain gripper 64 which is common to the ink drying processing unit 20, the UV irradiation processing unit 22, and the sheet discharge unit 24.

The sheet feed control unit 112 controls the operation of each unit of the sheet feed unit 12, such as the driving of the sheet feed roller pair 34 and the driving of the tape feeder 36A, in response to commands from the system controller 100.

The process liquid application control unit 114 controls the operation of each unit of the process liquid applying unit 14 (for example, the amount of process liquid applied and the application time of the process liquid), such as the operation of the process liquid applying unit 44, in response to commands from the system controller 100.

The process liquid drying control unit 116 controls the operation of each unit of the process liquid drying processing unit 16 in response to commands from the system controller 100. That is, the process liquid drying control unit 116 controls the operation of the process liquid drying unit 50 (see FIG. 1), such as drying temperature, the flow rate of dry air, and the blowing time of dry air.

The image forming control unit 118 controls the discharge (ejection) of ink from the image forming unit 18 (the ink jet heads 56C, 56M, 56Y, and 56K) in response to commands from the system controller 100.

That is, the image forming control unit 118 illustrated in FIG. 2 includes an image processing unit, a driving waveform generation unit, a driving waveform storage unit, and a driving circuit (a head driver and a driving voltage supply unit). The image processing unit forms dot data from input image data. The driving waveform generation unit generates the waveform of a driving voltage. The driving waveform storage unit stores the waveform of the driving voltage. The driving circuit supplies a driving voltage with a driving waveform corresponding to the dot data to each of the ink jet heads 56C, 56M, 56Y, and 56K.

Examples of the driving voltage include an ejection driving voltage for ejecting ink and a non-ejection driving voltage for preventing ink from being ejected. Examples of the non-ejection driving voltage include a meniscus micro-vibration voltage for finely vibrating a meniscus to such an extent that ink is not ejected and a driving voltage which prevents a piezoelectric element 230 from operating.

The meniscus micro-vibration voltage may have a smaller amplitude than the ejection driving voltage (for example, an amplitude that is half the amplitude of the ejection driving voltage) and a high-frequency pulse voltage (for example, a frequency that is ten times higher than that of the ejection driving voltage) may be applied as the meniscus micro-vibration voltage. In addition, the meniscus micro-vibration voltage may be a combination of these voltages.

The supply of the driving voltage which does not operate the piezoelectric element is synonymous with the non-supply of a driving voltage. In the following description, the "driving voltage" simply means the ejection driving voltage.

The image processing unit performs a color separation (division) process of separating input image data (raster data represented by a digital value of 0 to 255) into R, and B, a color conversion process of converting R, and B into C, M, Y, and K, a correction process, such as a gamma correction process or an unevenness correction process, and a halftone process of converting data of each color having an M value into data of each color having an N value (M>N; M is an integer equal to or greater than 3 and N is an integer of equal to or greater than 2).

The discharge time of ink to each pixel position and the amount of ink discharged are determined on the basis of dot data generated by the process of the image processing unit. A driving voltage corresponding to the discharge time of ink to each pixel position and the amount of ink discharged is generated. The driving voltage is supplied to the ink jet heads 56C, 56M, 56Y, and 56K. Dots are formed at each pixel position by ink droplets discharged from the ink jet heads 56C, 56M, 56Y, and 56K.

The ink drying control unit 120 controls the operation of the ink drying processing unit 20 in response to commands from the system controller 100. That is, the ink drying control unit 120 controls the operation of the ink drying unit 68 (see FIG. 1), such as drying temperature, the flow rate of dry air, and the blowing time of dry air.

The UV irradiation control unit 122 controls the amount of UV light irradiated by the UV irradiation processing unit 22 (the intensity (amount of irradiation) of UV light) in response to commands from the system controller 100 and also controls the irradiation time of the UV light.

The sheet discharge control unit 124 controls the operation of the sheet discharge unit 24 such that the sheet P is stacked on the sheet discharge tray 76, in response to commands from the system controller 100.

The maintenance control unit 126 controls the maintenance unit 90 which maintains the ink jet heads 56C, 56M, 56Y, and 56K (see FIG. 1) in response to commands from the system controller 100.

Figure 7:
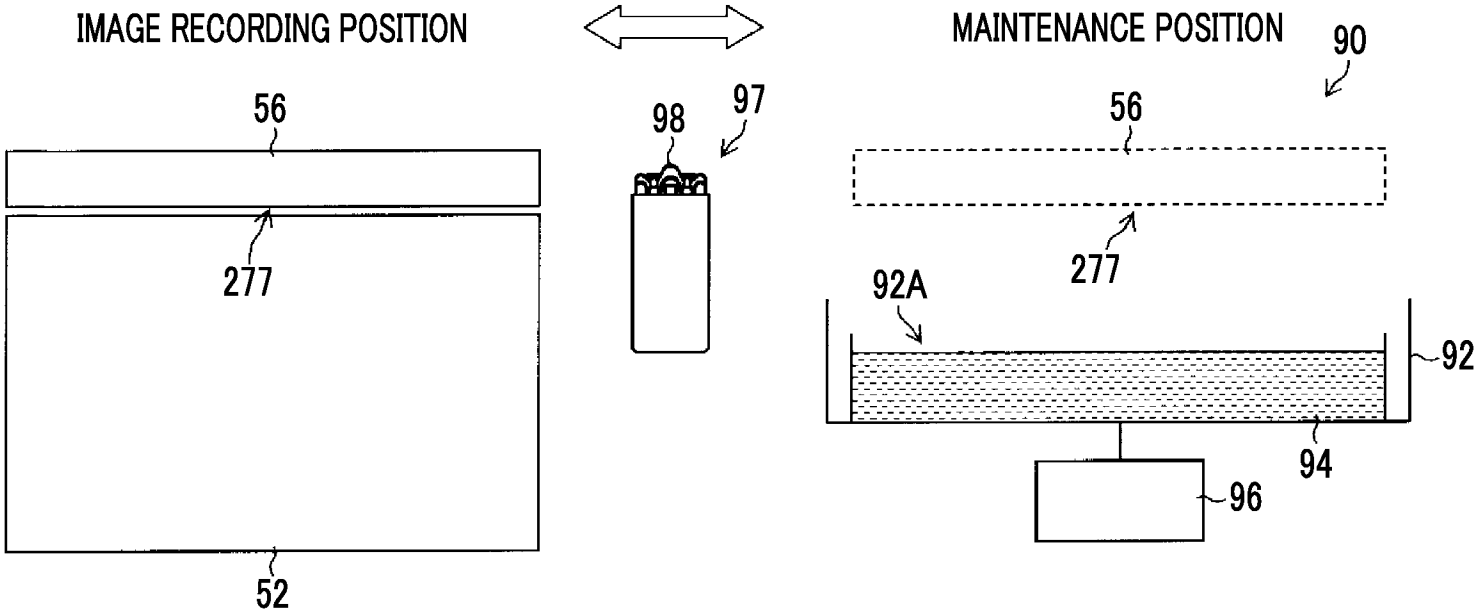
FIG. 7 is a layout diagram schematically illustrating the relationship between an image recording position and a maintenance position.

The maintenance control unit 126 controls the operation of a moving mechanism which moves the ink jet heads 56C, 56M, 56Y, and 56K from an image recording position to a maintenance position and controls the operation of a moving mechanism of a standby cap portion (which is not illustrated in FIG. 2 and is represented by reference numeral 92 in FIG. 7).

In addition, the maintenance control unit 126 controls an internal pressure adjustment unit (not illustrated) which adjusts the internal pressure of the ink jet heads 56C, 56M, 56Y, and 56K and a driving circuit which applies the driving voltage to the ink jet heads 56C, 56M, 56Y, and 56K during a dummy jet through the system controller 100.

The operating unit 130 includes operating members, such as operation buttons, a keyboard, and a touch panel, and transmits operation information which is input from operating means to the system controller 100. The system controller 100 performs various processes according to the operation information transmitted from the operating unit 130.

The display unit 132 includes a display device, such as an LCD panel, and displays information, such as various kinds of setting information of the device and abnormality information, on the display device in response to commands from the system controller 100.

[Structure of Ink Jet Head]

Next, the structure of the ink jet head according to the embodiment of the invention will be described in detail.

<Overall Structure>

Figure 3:
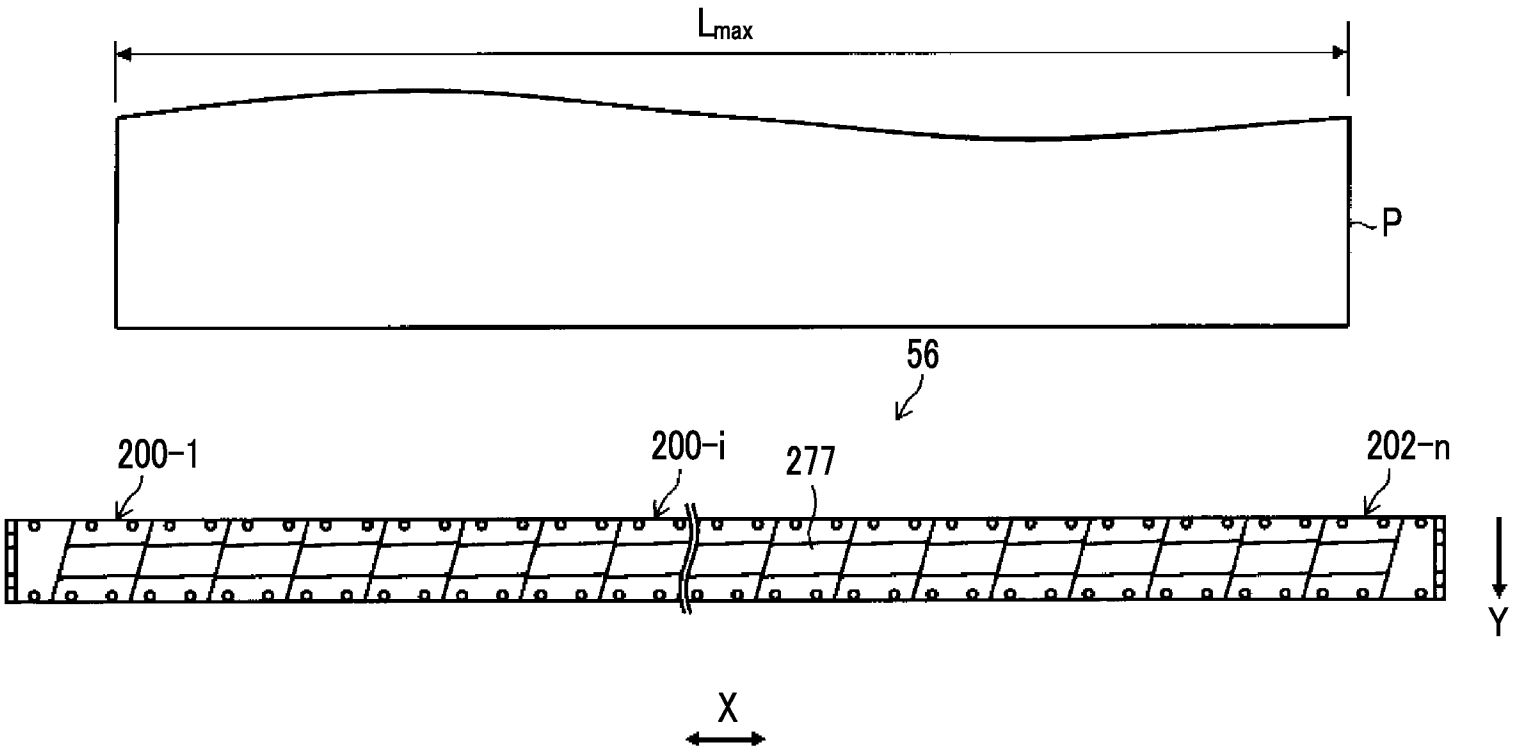
FIG. 3 is a plan view illustrating an ink jet head as viewed from an ink ejection surface.

FIG. 3 is a diagram illustrating the structure of the ink jet heads 56C, 56M, 56Y, and 56K illustrated in FIG. 1. The same structure is applied to the ink jet heads 56C, 56M, 56Y, and 56K which respectively correspond to C, M, Y, and K. Therefore, when the ink jet heads 56C, 56M, 56Y, and 56K do not need to be distinguished from each other, the alphabetical characters of the ink jet heads 56C, 56M, 56Y, and 56K may be omitted.

The ink jet head 56 illustrated in FIG. 3 has a structure in which a plurality of head modules 200 are connected in the width direction of the sheet P (X direction) perpendicular to the relative transportation direction of the sheet P (Y direction).

A suffix number (an integer after "-" (hyphen)) appended to the head module 200 indicates that the head module is an i-th (an integer from 1 to n) head module.

A plurality of nozzle openings (which are not illustrated in FIG. 3 and are represented by reference numerals 280A and 280B in FIG. 5) are provided in an ink ejection surface 277 of each head module 200.

That is, the ink jet head 56 illustrated in FIG. 3 is a full-line ink jet head (single-pass and page-wide head) in which a plurality of nozzle openings are arranged over a length corresponding to the overall width $L_{max}$ of the sheet P.

Here, the "overall width $L_{max}$ of the sheet P" is the overall length of the sheet P in the X direction perpendicular to the relative transportation direction (Y direction) of the sheet P. The term "perpendicular" includes an aspect in which the same operation and effect as those when the intersection angle is substantially 90° are obtained among aspects in which the intersection angle is less than or greater than 90°.

<Example of Structure of Head Module>

Figure 4:
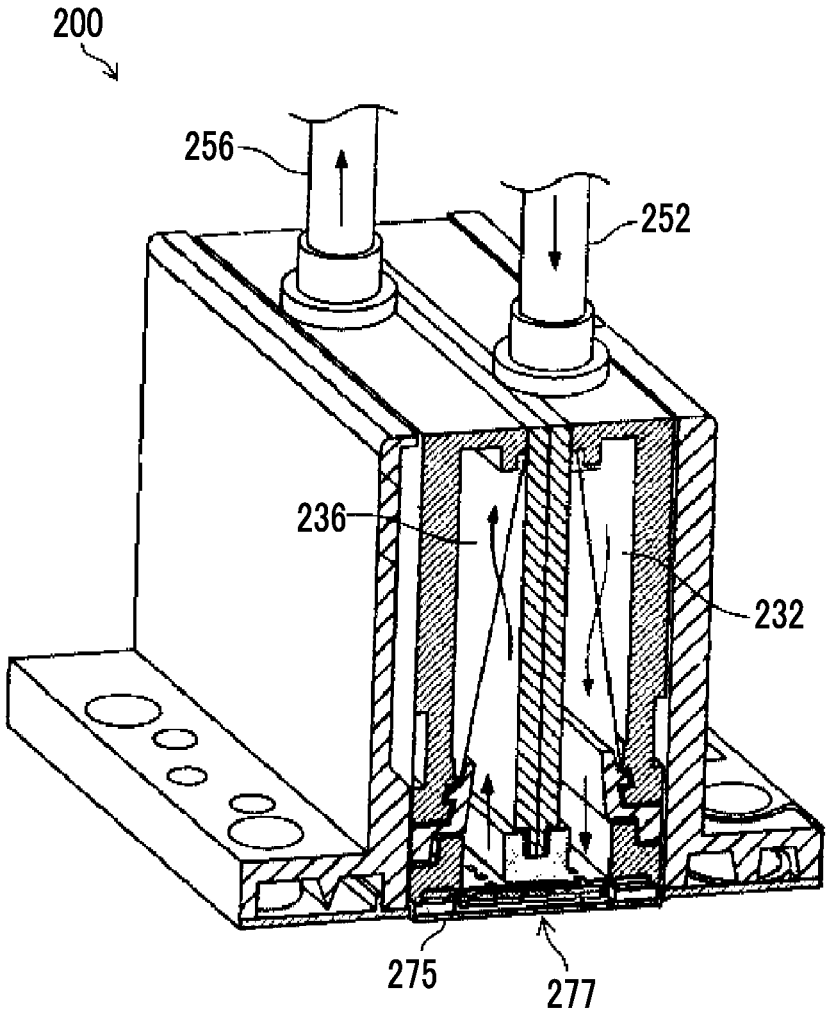
FIG. 4 is a perspective view illustrating an example of the structure of a head module.
Figure 5:
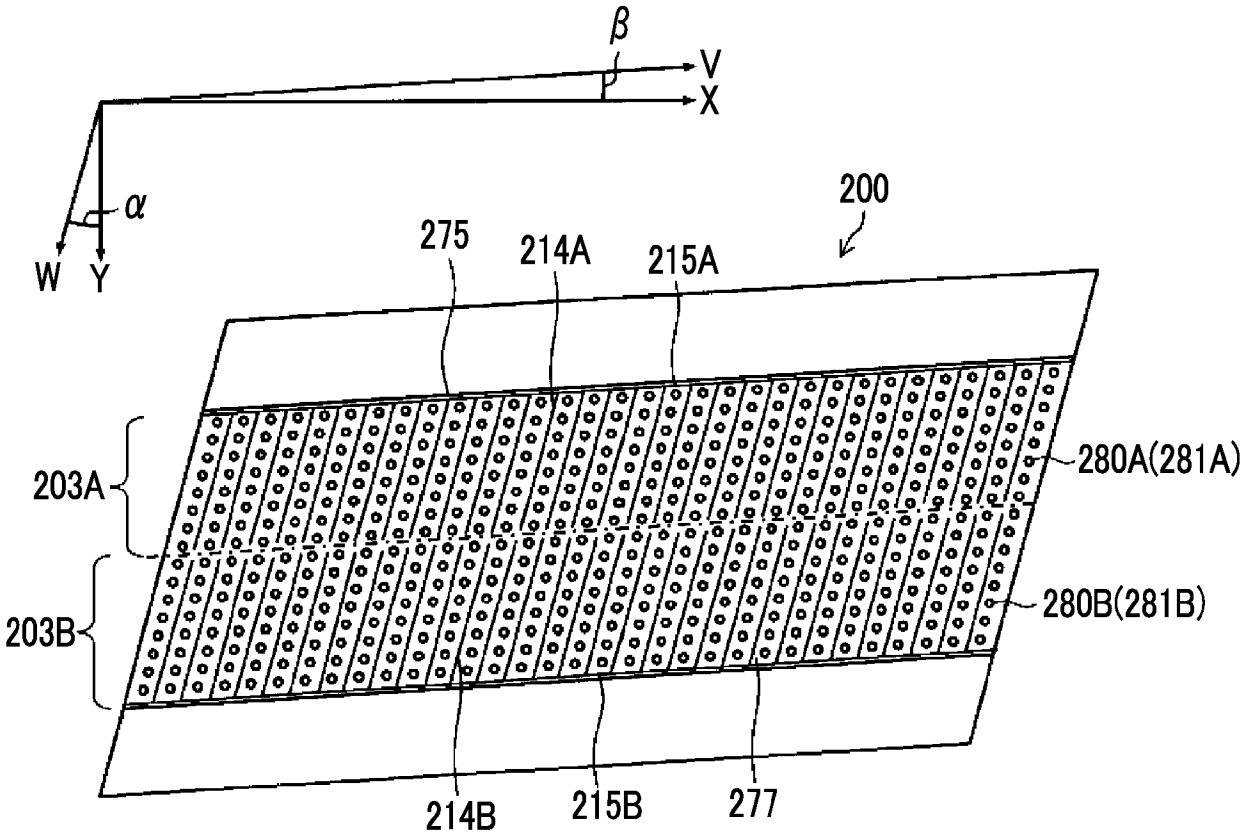
FIG. 5 is a diagram illustrating the arrangement of nozzles in the head module.

FIG. 4 is a perspective view (including a partial cross-sectional view) illustrating the head module 200. FIG. 5 is a perspective plan view illustrating the ink ejection surface 277 of the head module 200 illustrated in FIG. 4.

As illustrated in FIG. 4, the head module 200 includes an ink supply unit including an ink supply chamber 232 and an ink circulation chamber 236 which are provided on the side (the upper side in FIG. 4) opposite to the ink ejection surface 277 of the nozzle plate 275.

The ink supply chamber 232 is connected to an ink tank (not illustrated) through a supply pipe line 252. The ink circulation chamber 236 is connected to a collection tank (not illustrated) through a circulation pipe line 256.

The number of nozzles is not illustrated in FIG. 5. However, a plurality of nozzle openings 280A and 280B are formed in a two-dimensional nozzle array on the ink ejection surface 277 of the nozzle plate 275 in one head module 200.

That is, the head module 200 has, in a plan view, a parallelogram shape which has a long-side end surface along a V direction which has an inclination of an angle β with respect to the X direction and a short-side end surface along a W direction which has an inclination of an angle α with respect to the Y direction. The plurality of nozzle openings 280A and 280B are arranged in a row direction along the V direction and a column direction along the W direction.

The head module 200 can be divided into two blocks 203A and 203B including independent nozzle openings 280A and 280B and independent flow paths connected to the nozzle openings 280A and 280B in the W direction.

In the first block 203A, a supply flow path 214A is provided for each nozzle column of a plurality of nozzle openings 280A (nozzle portions 281A) which are arranged in the W direction. The plurality of supply flow paths 214A are connected to a main flow path and 215A which is provided in the V direction.

Similarly, in the second block 203B, a supply flow path 214B is provided for each nozzle column of a plurality of nozzle openings 280B (nozzle portions 281B) which are arranged in the W direction along the nozzle column. The plurality of supply flow paths 214B are connected to a main flow path 215B which is provided in the V direction.

Ink is supplied from the same supply flow path 214A to the nozzle portions 281A belonging to the same nozzle row. Ink is supplied from the same supply flow path 214B to the nozzle portions 281B belonging to the same nozzle row.

In the aspect illustrated in FIG. 5, the number of nozzle portions 281A in the first block 203A is equal to the number of nozzle portions 281B in the second block 203B. The nozzle portions 281A and the nozzle portions 281B have the same arrangement.

The arrangement of the nozzle openings 280A and 280B is not limited to the aspect illustrated in FIG. 5. For example, the plurality of nozzle openings 280A and 280B may be arranged in the row direction along the X direction and the column direction which obliquely intersects the X direction.

Figure 6:
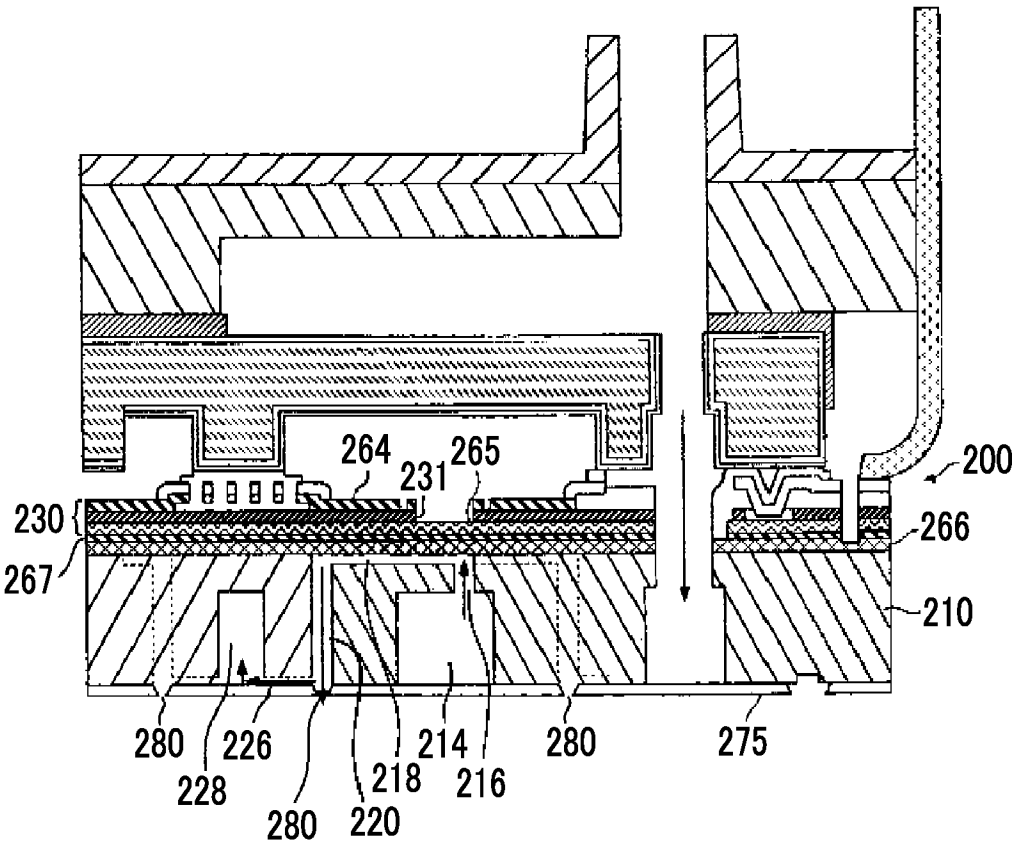
FIG. 6 is a cross-sectional view illustrating the internal structure of the head module.

FIG. 6 is a cross-sectional view illustrating the internal structure of the head module 200. Reference numeral 214 indicates an ink supply path. Reference numeral 218 indicates a pressure chamber (liquid chamber). Reference numeral 216 indicates an individual supply path which connects each pressure chamber 218 and the supply flow path 214. Reference numeral 220 indicates a nozzle connection path which connects the pressure chamber 218 and the nozzle opening 280. Reference numeral 226 indicates an individual circulation flow path which connects the nozzle connection path 220 and a common circulation flow path 228.

A diaphragm 266 is provided on a flow path structure 210 forming these flow path portions (214, 216, 218, 220, 226, and 228). A piezoelectric element 230 (pressurizing element) which has a laminated structure of a lower electrode (common electrode) 265, a piezoelectric layer 231, and an upper electrode (individual electrode) 264 is provided above the diaphragm 266, with an adhesive layer 267 interposed therebetween.

The upper electrode 264 is an individual electrode which is patterned so as to correspond to the shape of each pressure chamber 218. The piezoelectric element 230 is provided for each pressure chamber 218.

The supply flow path 214 is connected to the ink supply chamber 232 described with reference to FIG. 4. Ink is supplied from the ink supply path to the pressure chamber 218 through the individual supply path 216. When a driving voltage is applied to the upper electrode 264 of the piezoelectric element 230 provided in the corresponding pressure chamber 218 on the basis of an image signal of the image to be formed, the piezoelectric element 230 and the diaphragm 266 are deformed to change the volume of the pressure chamber 218. Then, ink is ejected from the nozzle opening 280 through the nozzle connection path 220 due to a change in pressure.

The driving of the piezoelectric element 230 corresponding to each nozzle opening 280 is controlled on the basis of dot arrangement data which is generated from image information to eject ink droplets from the nozzle openings 280. While the sheet P (see FIG. 3) is transported in the Y direction at a constant speed, the ejection time of ink from each nozzle opening 280 is controlled according to the transportation speed, which makes it possible to record a desired image on the sheet.

Although not illustrated in the drawings, the pressure chamber 218 which is provided so as to correspond to each nozzle opening 280 has a substantially square shape in a plan view. An outlet to the nozzle opening 280 is provided at one of two corners on a diagonal line and an inlet (supply port) 216 for supplying ink is provided at the other corner.

The shape of the pressure chamber is not limited to a square. Alternatively, the pressure chamber may have various planar shapes, such as a quadrangle (for example, a rhombus or a rectangle), a pentagon, a hexagon, other polygons, a circle, and an ellipse.

The common circulation flow path 228 is connected to the ink circulation chamber 236 described with reference to FIG. 5. Ink is constantly collected to the common circulation flow path 228 through the individual circulation flow path 226, which prevents ink in the nozzle portion from thickening during a non-ejection (non-driving) operation.

In this example, the ink jet head ejects ink using the piezoelectric element. However, the ink jet head may be a thermal type which generates a film boiling phenomenon using a heating element provided in the liquid chamber to eject ink.

[Description of Maintenance of Ink Jet Head]

FIG. 7 is a layout diagram schematically illustrating the relationship between the image recording position and the maintenance position. In FIG. 7, only one of the ink jet heads 56C, 56M, 56Y, and 56K which are arranged in the depth direction of the plane of paper is represented by reference numeral 56 and is illustrated, and the other ink jet heads are not illustrated.

The maintenance unit 90 illustrated in FIG. 7 includes the standby cap portion 92, an ink receiver 94, a waste tank 96, and a wiping processing unit 97. Reference numeral 92A indicates the liquid level (the surface on which ink is landed during a dummy jet) of the standby cap portion 92.

The ink jet head 56 represented by a solid line in FIG. 7 is arranged at the image recording position. The image recording position is a position where ink is ejected in order to form an image on the sheet P transported by the image forming drum 52 (see FIG. 1).

The distance (throw distance) between the sheet P and the ink ejection surface 277 of the ink jet head 56 at the image recording position is in the range of 1 to 2 millimeters.

In order to move the ink jet head 56 from the image recording position to the maintenance position, a head mechanism (not illustrated) is operated to move the ink jet head 56 upward in the vertical direction and then move the ink jet head 56 in the horizontal direction (a direction parallel to the longitudinal direction of the ink jet head 56).

In FIG. 7, the ink jet head 56 arranged at the maintenance position is represented by a dashed line. When the ink jet head 56 is moved to the maintenance position, a standby cap portion moving mechanism (not illustrated) is used to move the standby cap portion 92 such that the standby cap portion 92 is mounted on the ink ejection surface 277 of the ink jet head 56.

Maintenance processes, such as a dummy jet, pressure purging, and suction, are performed for the ink jet head 56, with the standby cap portion 92 mounted on the ink ejection surface 277. When these processes end, the standby cap portion 92 is separated from the ink ejection surface 277 of the ink jet head 56 and the ink jet head 56 is moved to the image recording position.

The wiping processing unit 97 is provided between the image recording position and the maintenance position of the ink jet head 56. In the wiping processing unit 97, a web 98 which is wetted with a cleaning liquid comes into contact with the ink ejection surface 277. In this state, the ink jet head 56 is moved and the ink ejection surface 277 is swept by the web 98.

FIG. 7 illustrates the maintenance unit 90 corresponding to one head. However, the structure illustrated in FIG. 7 may be provided so as to correspond to each of the ink jet heads 56C, 56M, 56Y, and 56K. Alternatively, one maintenance unit 90 may be used to perform the maintenance process for all of the ink jet heads 56C, 56M, 56Y, and 56K.

The standby cap portion 92 illustrated in FIG. 7 is inclined with respect to the horizontal plane so as to correspond to the inclination of the ink jet head 56 with respect to the horizontal plane, which is not illustrated in detail in FIG. 7. The standby cap portion 92 illustrated in FIG. 7 is inclined in a direction from the front surface to the rear surface of FIG. 7 or a direction from the rear surface to the front surface of FIG. 7 (see FIGS. 23A and 23B).

[Detailed Description of Dummy Jet]

<Description of Division Driving Ejection>

Next, the dummy jet of the ink jet head 56 will be described. The dummy jet which will be described below has a structure in which one head module 200 forming the ink jet head 56 is divided into four groups and the dummy jet is sequentially performed for each group.

FIGS. 8 to 11 are diagrams illustrating division driving ejection in the dummy jet and are plan views schematically illustrating an ink ejection surface indicating the nozzle portions 281 (nozzle openings 280) which belong to the first to fourth groups in the dummy jet.

In FIGS. 8 to 11, one square-shaped mass indicates the nozzle portion 281 (nozzle opening 280), a black mass indicates the nozzle portion 281 belonging to each group, and a white mass indicates the nozzle portion 281 belonging to the other groups.

In FIGS. 8 to 11, only one head module 200 forming the ink jet head 56 is illustrated and a white portion (a non-forming portion in which the nozzle opening 280 is not formed) at the center in the W direction (Y direction in FIG. 5) is a gap portion 203C which is the boundary between the blocks forming one head module 200. In FIG. 5, the gap portion 203C is represented by a one-dot chain line and does not have a reference numeral. In FIGS. 8 to 11, it is assumed that the upper block is a first block 203A and the lower block is a second block 203B.

In FIGS. 8 to 11, the vertical direction (up-down direction) is the W direction (the direction of the nozzle column) in FIG. 5, the horizontal direction (left-right direction) is the V direction in FIG. 5, and the inclined lattice in the arrangement of the nozzle portions 281 in FIG. 5 is replaced with a square lattice.

Figure 8:
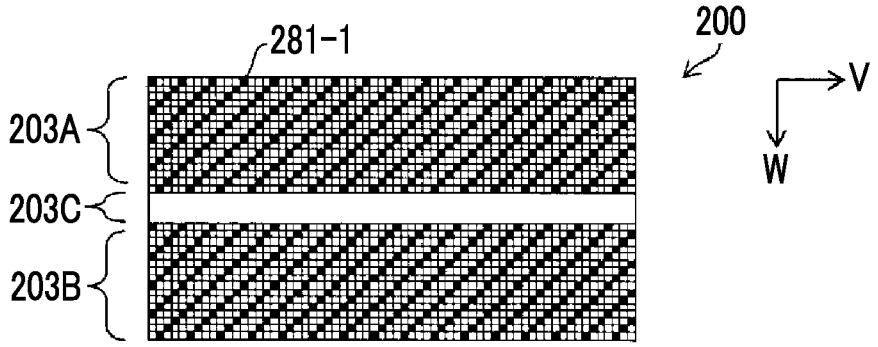
FIG. 8 is a plan view schematically illustrating an ink ejection surface indicating nozzle portions belonging to a first group in division driving ejection during a dummy jet.
Figure 9:
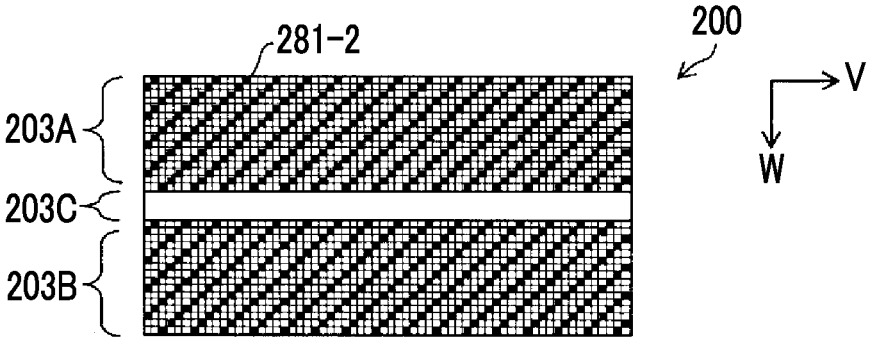
FIG. 9 is a plan view schematically illustrating an ink ejection surface indicating nozzle portions belonging to a second group in the division driving ejection during the dummy jet.
Figure 10:
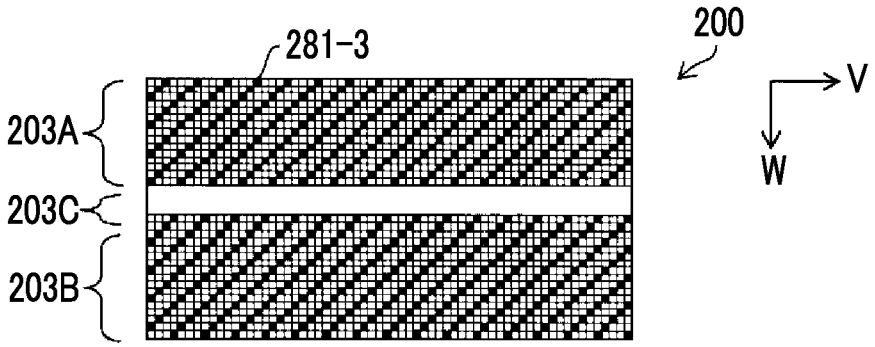
FIG. 10 is a plan view schematically illustrating an ink ejection surface indicating nozzle portions belonging to a third group in the division driving ejection during the dummy jet.
Figure 11:
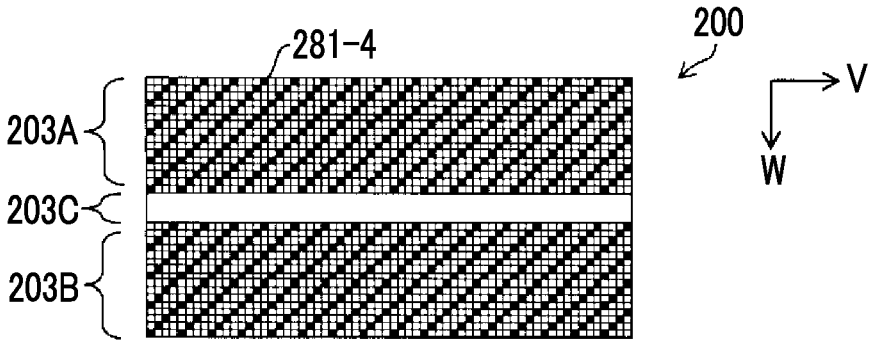
FIG. 11 is a plan view schematically illustrating an ink ejection surface indicating nozzle portions belonging to a fourth group in the division driving ejection during the dummy jet.

Nozzle portions 281-1 belonging to the first group illustrated in FIG. 8 are arranged at an interval of four nozzles in the V direction and the W direction. Similarly, nozzle portions 281-2 belonging to the second group illustrated in FIG. 9 are arranged at an interval of four nozzles in the V direction and the W direction. Nozzle portions 281-3 belonging to the third group illustrated in FIG. 10 are arranged at an interval of four nozzles in the V direction and the W direction. Nozzle portions 281-4 belonging to the fourth group illustrated in FIG. 11 are arranged at an interval of four nozzles in the V direction and the W direction.

The nozzle portion 281-1 belonging to the first group and the nozzle portion 281-2 belonging to the second group are adjacent to each other in the V direction and the W direction. Similarly, the nozzle portion 281-2 belonging to the second group and the nozzle portion 281-3 belonging to the third group are adjacent to each other in the V direction and the W direction. The nozzle portion 281-3 belonging to the third group and the nozzle portion 281-4 belonging to the fourth group are adjacent to each other in the V direction and the W direction. The nozzle portion 281-4 belonging to the fourth group and the nozzle portion 281-1 belonging to the first group are adjacent to each other in the V direction and the W direction.

That is, the head module 200 is configured such that adjacent nozzle portions 281 belong to different groups in the V direction and the W direction and the nozzle portions belonging to the same group are arranged in a direction which is inclined with respect to the V direction and the W direction.

In other words, among the nozzle portions 281 which belong to the same group, the distance between nozzle portions 281 which are connected to the same supply flow path 214A or 214B (see FIG. 5) (the nozzle portions 281 in the same nozzle column) is equal to or greater than a value corresponding to two nozzles.

Figure 12:
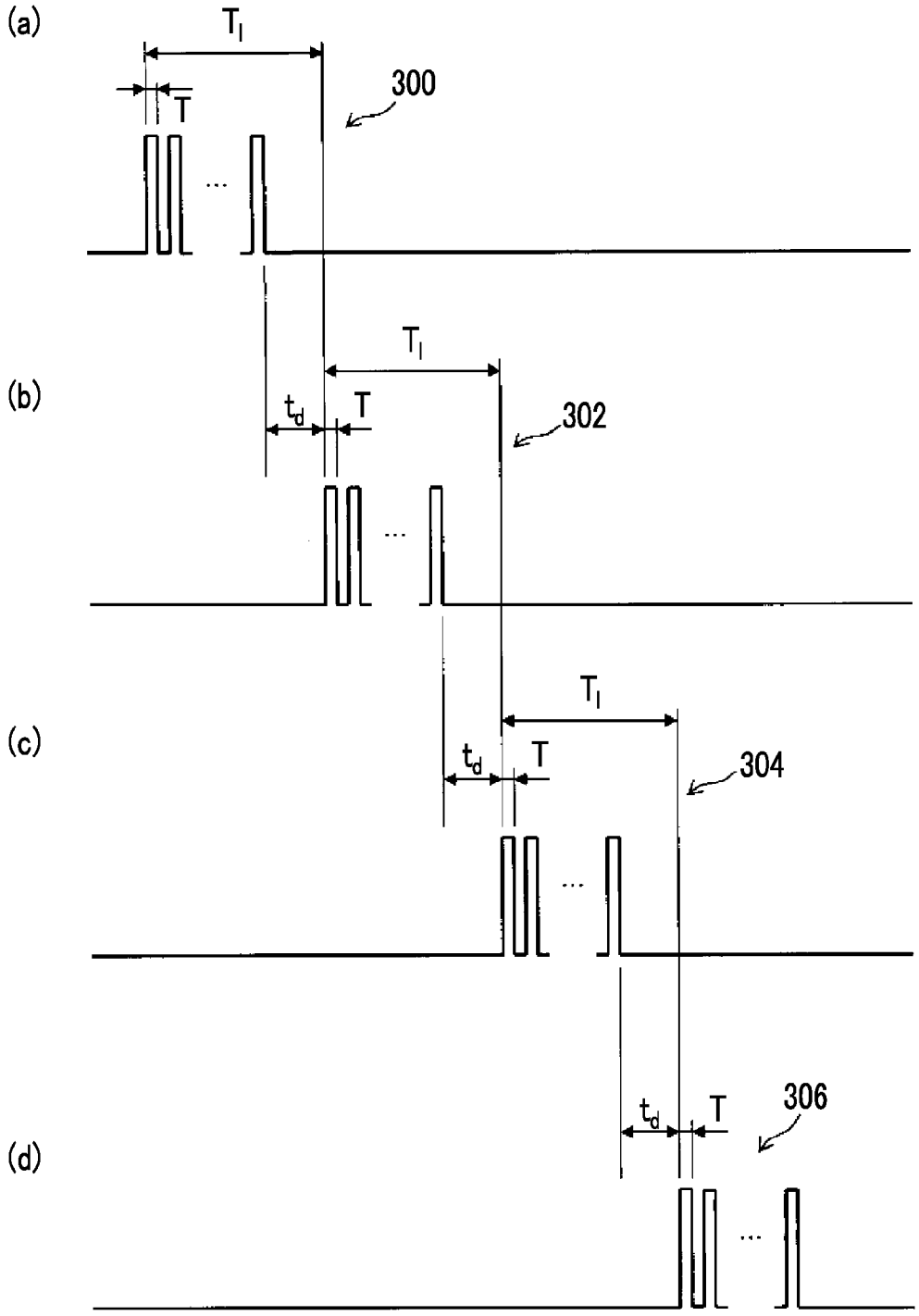
FIG. 12 is a diagram illustrating the application time of a driving voltage to each group during the dummy jet.

(a) to (d) of FIG. 12 are diagrams illustrating driving voltages 300, 302, 304, and 306 which are applied to each group and the supply time of the driving voltage in the dummy jet.

As illustrated in (a) to (d) of FIG. 12, the driving voltage applied to one group is a pulse voltage corresponding to the number of ejections which has an ejection period T and a non-supply period (time difference) $t_d$ is provided between the driving voltage applied to one group and the driving voltage applied to another group.

That is, the dummy jet according to this example is performed for each group. When the dummy jet for one group ends, the dummy jet is performed for the next group after a predetermined driving voltage non-supply period $t_d$ has elapsed (time interval driving).

In other words, for the period for which the dummy jet is performed for a given group, the dummy jet is not performed for the other groups. That is, the non-ejection driving voltage is supplied to the piezoelectric elements 230 (see FIG. 6) corresponding to the nozzle portions 281 belonging to the other groups. For the groups for which the dummy jet is performed, ink is ejected from the nozzle portions 281 belonging to the same group (see FIGS. 8 to 11) at the same time. That is, the ejection driving voltage is supplied to the piezoelectric elements 230 corresponding to the nozzle portions 281 belonging to the group for which the dummy jet is performed.

The non-ejection driving voltage is generated in the driving circuit illustrated in FIG. 2 and is supplied to the piezoelectric element 230 (see FIG. 6), similarly to the ejection driving voltage.

In the group for which the dummy jet is not performed, when the non-ejection driving voltage is supplied, the meniscus in the nozzle portion 281 is finely vibrated to prevent the drying of ink in the vicinity of the nozzle opening 280.

(a) of FIG. 12 illustrates the driving voltage (ejection driving voltage) 300 which is supplied to the piezoelectric element 230 (see FIG. 6) corresponding to the nozzle portion 281-1 (see FIG. 8) belonging to the first group. The driving voltage 300 illustrated in (a) of FIG. 12 includes a pulse voltage corresponding to the number of ejections in one dummy jet and the frequency of the driving voltage is the highest ejection frequency used to form an image.

Similarly, (b) of FIG. 12 illustrates the driving voltage 302 which is supplied to the piezoelectric element 230 corresponding to the nozzle portion 281-2 (see FIG. 9) belonging to the second group. (c) of FIG. 12 illustrates the driving voltage 304 which is supplied to the piezoelectric element 230 corresponding to the nozzle portion 281-3 (see FIG. 10) belonging to the third group. (d) of FIG. 12 illustrates the driving voltage 306 which is supplied to the piezoelectric element 230 corresponding to the nozzle portion 281-4 (see FIG. 11) belonging to the fourth group.

The period $T_I$ between the start edge of the driving voltage 300 (the rising edge of an initial pulse voltage) and the start edge of the driving voltage 302 (the rising edge of an initial pulse voltage) is longer than a period obtained by multiplying the period T which is calculated as the reciprocal of an ejection frequency applied to the dummy jet by the number of ejections in the dummy jet.

Similarly, the period between the start edge of the driving voltage 302 and the start edge of the driving voltage 304 and the period between the start edge of the driving voltage 304 and the start edge of the driving voltage 306 are longer than a period obtained by multiplying a period T longer than the period T which is calculated as the reciprocal of the ejection frequency applied to the dummy jet by the number of ejections in the dummy jet.

Similarly to the driving voltage 300, each of the driving voltages 302, 304, and 306 includes a pulse voltage corresponding to the number of ejections in one dummy jet and the frequency thereof is the highest ejection frequency used to form an image.

A period difference $t_d$ between the supply start times of the driving voltages 300, 302, 304, and 306 in the groups can be appropriately determined.

Figure 13A:
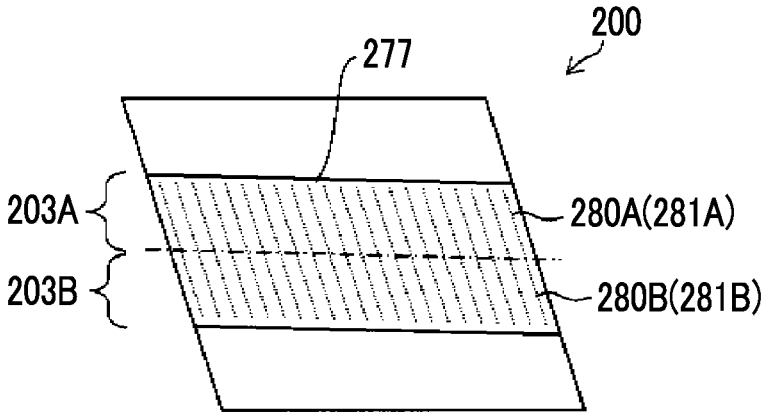
FIG. 13A is a plan view schematically illustrating an aspect of the attachment of mist to the ink ejection surface when the division driving ejection is performed and FIG. 13B is a plan view schematically illustrating an aspect of the attachment of mist to the ink ejection surface when collective driving ejection is performed.
Figure 13B:
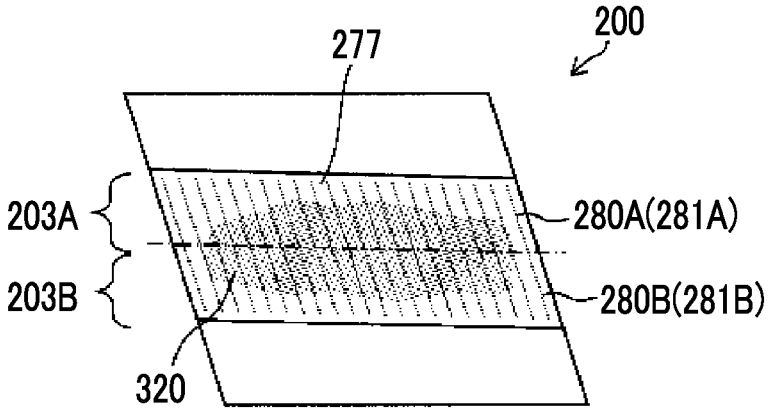

FIGS. 13A and 13B are plan views of the ink ejection surface 277 which schematically illustrate aspects in which mist is attached to the ink ejection surface 277. FIG. 13A illustrates the aspect in which mist is attached to the ink ejection surface 277 when the division driving ejection is performed and FIG. 13B illustrates the aspect in which mist is attached to the ink ejection surface 277 when collective driving ejection is performed.

The conditions of the dummy jet are as follows:

The number of nozzles per head module: 2048 nozzles;

The number of divisions: 4 (512 nozzles);

The number of dummy jets (the number of ejections): 20000;

The ejection frequency: 25 kHz;

The amount of ink ejected in one ejection operation: 9 picoliters; and

The distance between the ink ejection surface and the liquid level (which is represented by reference numeral 92A in FIG. 14): 3.4 millimeters.

The dummy jet was performed for all of the head modules forming the ink jet head under these conditions and the ink ejection surface 277 of each head module was visibly inspected to check the attachment state of mist. As a comparative example, the division driving ejection was not performed, the collective driving ejection was performed, ink was ejected from all of the nozzle portions 281A and 281B of all of the head modules at the same time to perform a dummy jet and the ink ejection surface 277 of each head module was visibly inspected to check the attachment state of mist.

FIGS. 13A and 13B illustrate the results for an arbitrary head module. When the division driving ejection illustrated in FIG. 13A is performed, little mist is attached to the ink ejection surface 277. On the other hand, when the collective driving ejection illustrated in FIG. 13B is performed, a large amount of mist 320 is attached to the ink ejection surface 277.

That is, when the division driving ejection is applied to the dummy jet, it is possible to significantly reduce the amount of mist attached to the ink ejection surface 277, as compared to the collective driving ejection according to the related art.

Here, the collective driving ejection means ink ejection which has been performed in the dummy jet in the related art. In the collective driving ejection, ink is ejected from all of the nozzle openings 280A and 280B of one head module 200 at the same time.

The reasons why the amount of mist attached to the ink ejection surface 277 is reduced by the division driving ejection are as follows.

(Reason 1)

The nozzle portions 281 which eject ink at the same time are arranged at an interval of three nozzles in the V direction and the W direction and the crosstalk between the nozzle portions 281 which eject ink at the same time is reduced.

Ink is ejected at the same time from the nozzle portions 281 which are supplied with ink from the same supply flow paths 214A and 214B, but the crosstalk between the nozzle portions 281 is reduced since the nozzle portions 281 are separated by a distance corresponding to three nozzles.

When the crosstalk is reduced, the ejection of ink from each nozzle portion 281 is stabilized and the amount of mist generated is reduced. As a result, the amount of mist attached to the ink ejection surface 277 is reduced.

(Reason 2)

Figure 14:
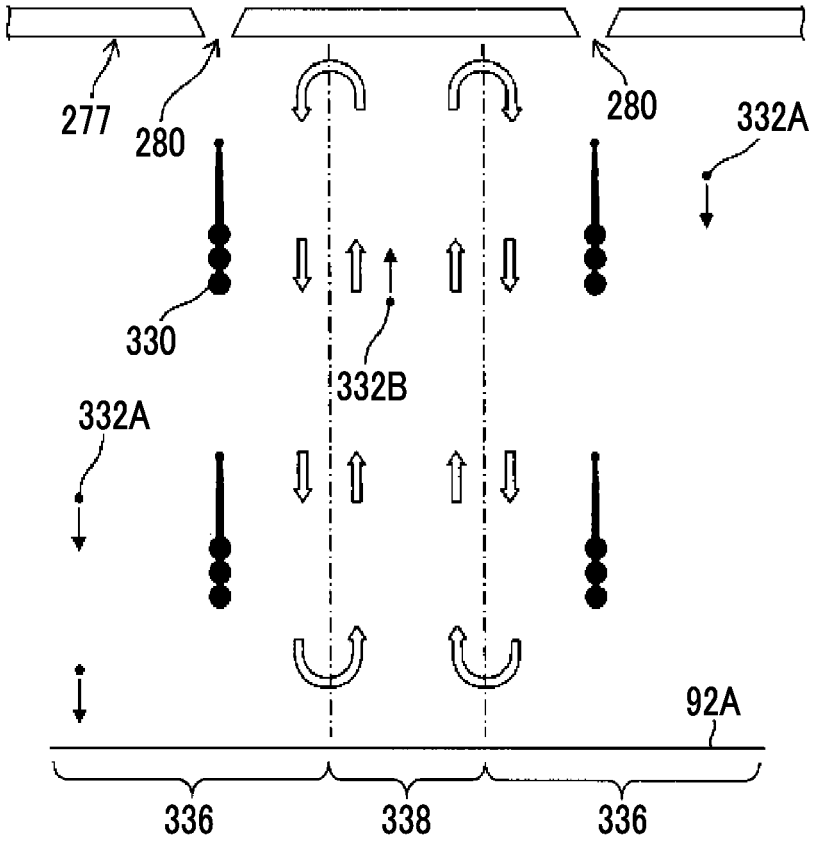
FIG. 14 is a diagram schematically illustrating a descending air current region and an ascending air current region in a space between the ink ejection surface and an ink landing surface.

FIG. 14 is a diagram schematically illustrating a descending air current region 336 and an ascending air current region 338 in a space between the ink ejection surface 277 and the liquid level 92A. When ink 330 is ejected from the nozzle opening 280, a descending air current (represented by a white down arrow) from the nozzle opening 280 to the liquid level 92A is generated around the nozzle opening 280 and the descending air current region 336 is formed.

In contrast, an ascending air current (represented by a white up arrow) is generated around the descending air current region 336 (a region between the nozzle openings 280) and the ascending air current region 338 is formed. When floating mist 332B which floats in a space between the ink ejection surface 277 and an ink landing surface enters the ascending air current region 338, the floating mist 332B moves to the ink ejection surface 277 and is attached to the ink ejection surface 277.

Floating mist 332A in the descending air current region 336 moves to the liquid level 92A and lands on the liquid level 92A.

In the case in which the division driving ejection is applied to the dummy jet, even when the floating mist 332A which floats in the space between the ink ejection surface 277 and the ink landing surface is generated, the floating mist is less likely to enter the ascending air current region 338 since the descending air current region 336 is wide due to a large gap between the nozzle openings 280 from which ink is ejected. As a result, the amount of mist which reaches the ink ejection surface 277 is reduced.

In this example, one head module 200 is divided into four groups. However, the number of groups may be equal to or greater than 2, considering the reason why the attachment of mist to the ink ejection surface 277 is suppressed. That is, the nozzle portions 281 belonging to the same group may be separated by a distance corresponding to two nozzles or more among the nozzle portions 281 which are supplied with ink from the same supply flow paths 214A and 214B.

When the number of groups increases, it is possible to improve the effect of suppressing the attachment of mist to the ink ejection surface 277. However, when the number of groups is too large, the whole processing time increases. Therefore, the number of groups may be determined, considering the whole processing period.

<For Ejection Frequency>

FIG. 15 is a table illustrating the attachment state of mist to the ink ejection surface according to a difference in ejection frequency during the dummy jet.

Here, a difference in the attachment of mist to the ink ejection surface 277 due to the difference in ejection frequency after the division driving ejection is applied will be described.

In the above-mentioned dummy jet conditions, the ejection frequency was set to 1 kilohertz (kHz), 2 kHz, 5 kHz, 10 kHz, 17 kHz, 25 kHz, and 29 kHz and the ink ejection surface 277 was visibly inspected to check the attachment state of mist.

In the evaluation of the amount of mist attached illustrated in FIG. 15, "good" indicates that no mist was attached to the ink ejection surface 277 (see FIG. 13) or little mist was attached to the ink ejection surface 277 (the amount of mist attached was in an allowable range) (see FIG. 13A). In contrast, in the evaluation of the amount of mist attached, "poor" indicates that a large amount of mist was attached to the ink ejection surface 277 (the amount of mist attached was beyond the allowable range) (see FIG. 13B).

As illustrated in FIG. 15, when the ejection frequency is 1 kHz, 2 kHz, and 5 kHz, the evaluation result of the amount of mist attached is "poor". When the ejection frequency is 10 kHz, 17 kHz, 25 kHz, and 29 kHz, the evaluation result of the amount of mist attached is "good".

That is, when the ejection frequency is equal to or higher than 10 kHz, it is possible to suppress the attachment of mist to the ink ejection surface 277. When the ejection frequency is relatively high, it is possible to improve the effect of suppressing the attachment of mist.

Figure 16:
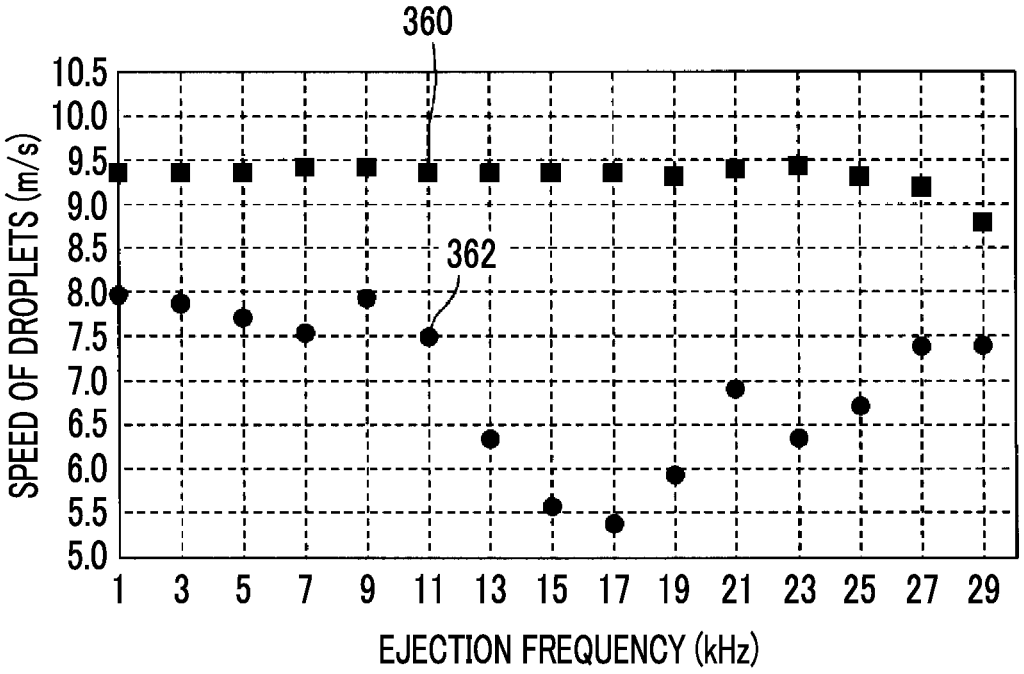
FIG. 16 is a graph illustrating the relationship between the ejection frequency and the speed of droplets in the dummy jet.
Figure 18A:
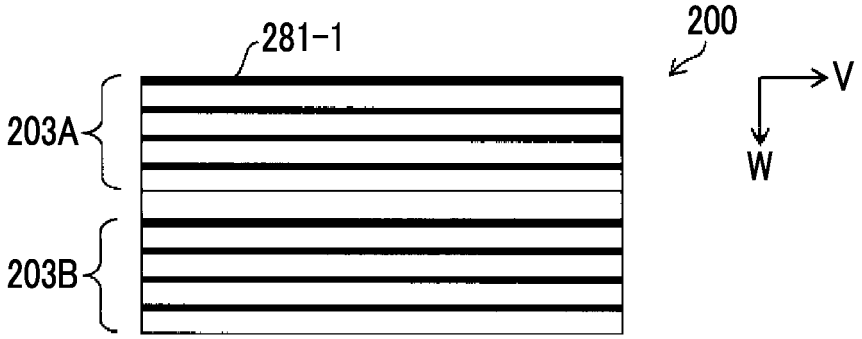
FIGS. 18A to 18D are diagrams illustrating another aspect of the division driving ejection during the dummy jet.
Figure 18B:
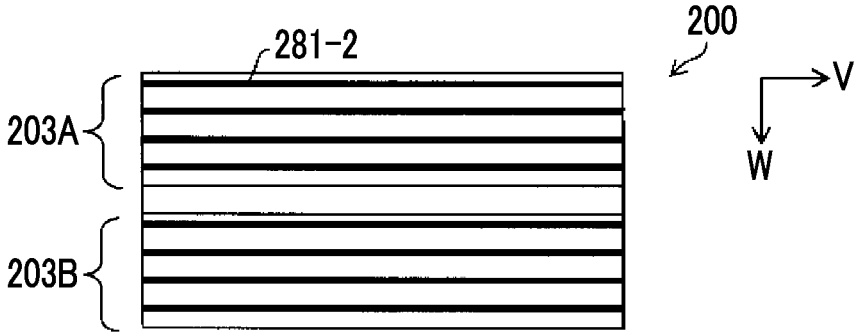
Figure 18C:
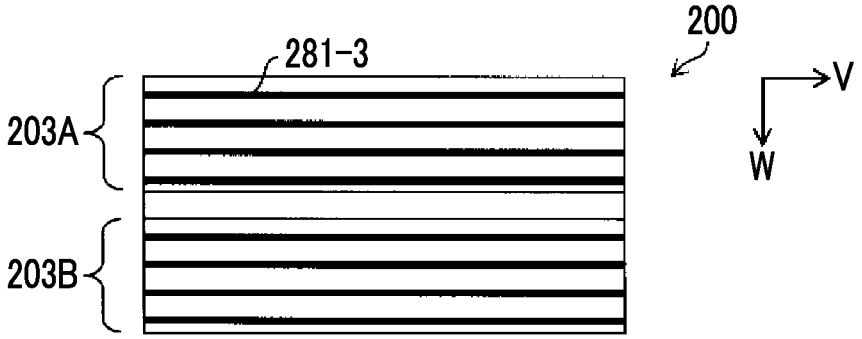
Figure 18D:
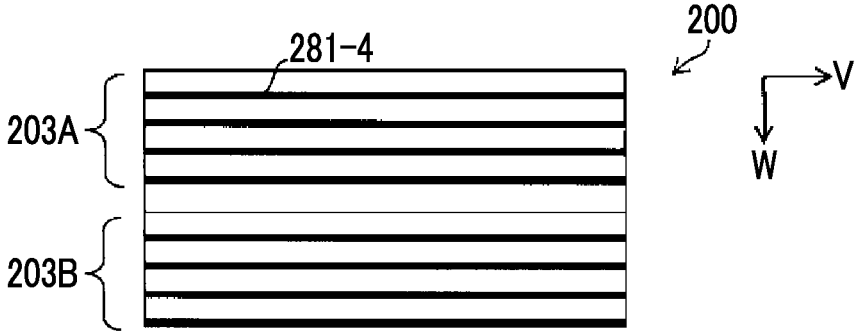

FIG. 16 is a graph illustrating the relationship between the ejection frequency and the speed of droplets in the dummy jet. In FIG. 16, the horizontal axis indicates the ejection frequency (kilohertz (kHz)) and the vertical axis indicates the ejection speed of ink droplets (meters per second (m/s)).

Data (represented by a black rectangle) denoted by reference numeral 360 is data when ink is ejected from only one nozzle opening 280 and data (represented by a black circle) denoted by reference numeral 362 is data when ink is ejected from all of the nozzle openings 280.

The speed of droplets when ink is ejected from only one nozzle opening 280, which is denoted by reference numeral 360, is constant at an ejection frequency of up to 25 kHz and is slightly reduced when the ejection frequency is greater than 25 kHz. In contrast, the ejection speed when ink is ejected from all of the nozzle openings 280, which is denoted by reference numeral 362, is significantly reduced at an ejection frequency of 17 kHz.

That is, the ejection speed is significantly reduced at an ejection frequency of 17 kHz due to the influence of crosstalk.

Therefore, as the ejection frequency of the dummy jet, it is preferable to avoid the frequency which is affected by crosstalk and to avoid ejection frequencies in the vicinity of the ejection frequency which is affected by crosstalk.

In the example illustrated in FIG. 16, it is preferable to avoid an ejection frequency of 11 kHz to 21 kHz. In order to know the ejection frequency which is affected by crosstalk, the relationship between the ejection frequency and the ejection speed is experimentally calculated and the range of the ejection frequency at which the ejection speed is significantly reduced is calculated.

As a method for measuring the "ejection speed of droplets" illustrated in FIG. 16, for example, there are the following methods: a method which captures an image of droplets and performs analysis on the basis of the imaging result; and a method which ejects droplets while moving a recording medium at a constant speed and analyzes dot rows formed on the recording medium.

<For Throw Distance>

FIG. 17 is a table illustrating the attachment state of ink mist to the ink ejection surface 277 (see FIG. 14) according to a difference in throw distance in the dummy jet. Here, the "throw distance" means the distance between the ink ejection surface 277 and the liquid level 92A.

In the above-mentioned dummy jet conditions, the throw distance was set to 3.4 millimeters (mm), 4.4 mm, 5.4 mm, 6.4 mm, and 8.4 mm and the ink ejection surface 277 was visibly inspected to check the attachment state of mist.

In the evaluation of the amount of mist attached illustrated in FIG. 17, "good" indicates that no mist was attached to the ink ejection surface 277 or little mist was attached to the ink ejection surface 277 (see FIG. 13A).

In contrast, in the evaluation of the amount of mist attached, "poor" indicates that a large amount of mist was attached to the ink ejection surface 277 (see FIG. 13B).

As illustrated in FIG. 17, when the throw distance is 3.4 mm, 4.4 mm, and 5.4 mm, the evaluation result of the amount of mist attached is "good". When the throw distance is 6.4 mm and 8.4 mm, the evaluation result of the amount of mist attached is "poor".

That is, when the throw distance is equal to or less than 5.4 mm (preferably equal to or less than 3.4 mm), it is possible to suppress the attachment of mist to the ink ejection surface 277.

When the throw distance is relatively short, the floating mist 332A (see FIG. 15) is moved by the descending air current and the amount of mist which lands on the liquid level 92A increases. As a result, the amount of mist which reaches the ink ejection surface 277 is reduced.

When the throw distance is less than 1 mm, the liquid from the liquid level 92A is affected by, for example, splashing. Therefore, it is preferable that the throw distance is equal to or greater than 1 mm.

<For Other Aspects of Division Driving Ejection>

FIGS. 18A to 18D are diagrams illustrating other aspects of the division driving ejection in the dummy jet. FIGS. 18A to 18D are plan views schematically illustrating the ink ejection surfaces indicating the nozzle portions 281 belonging to the first to fourth groups.

In FIGS. 18A to 18D, the same or similar portions as those in FIGS. 8 to 11 are denoted by the same reference numerals and the description thereof will not be repeated. In addition, in FIGS. 18A to 18D, a mass indicating the nozzle portion 281 is not illustrated.

The first to fourth groups illustrated in FIGS. 18A to 18D are similar to those in FIGS. 8 to 11 in that all of the nozzle portions 281 of one head module 200 are divided into four groups.

In the aspect illustrated in FIGS. 18A to 18D, the nozzle portions 281 which are arranged in the V direction belong to the same group and the nozzle portions 281 which are adjacent to each other in the W direction belong to different groups.

The nozzle portions 281 belonging to the same group are separated by a distance corresponding to four nozzles in the W direction. The nozzle portions 281 which are supplied with ink from the same supply flow paths 214A and 214B (see FIG. 5) are separated by a distance corresponding to four or more nozzles.

In the aspect illustrated in FIGS. 18A to 18D, when the division driving ejection was performed under the same conditions as the division driving ejection illustrated in FIG. 13A, using the driving voltages illustrated in (a) to (d) of FIG. 12, the amount of mist attached was slightly more than that in the state illustrated in FIG. 13A, but good results could be obtained.

Figure 19:
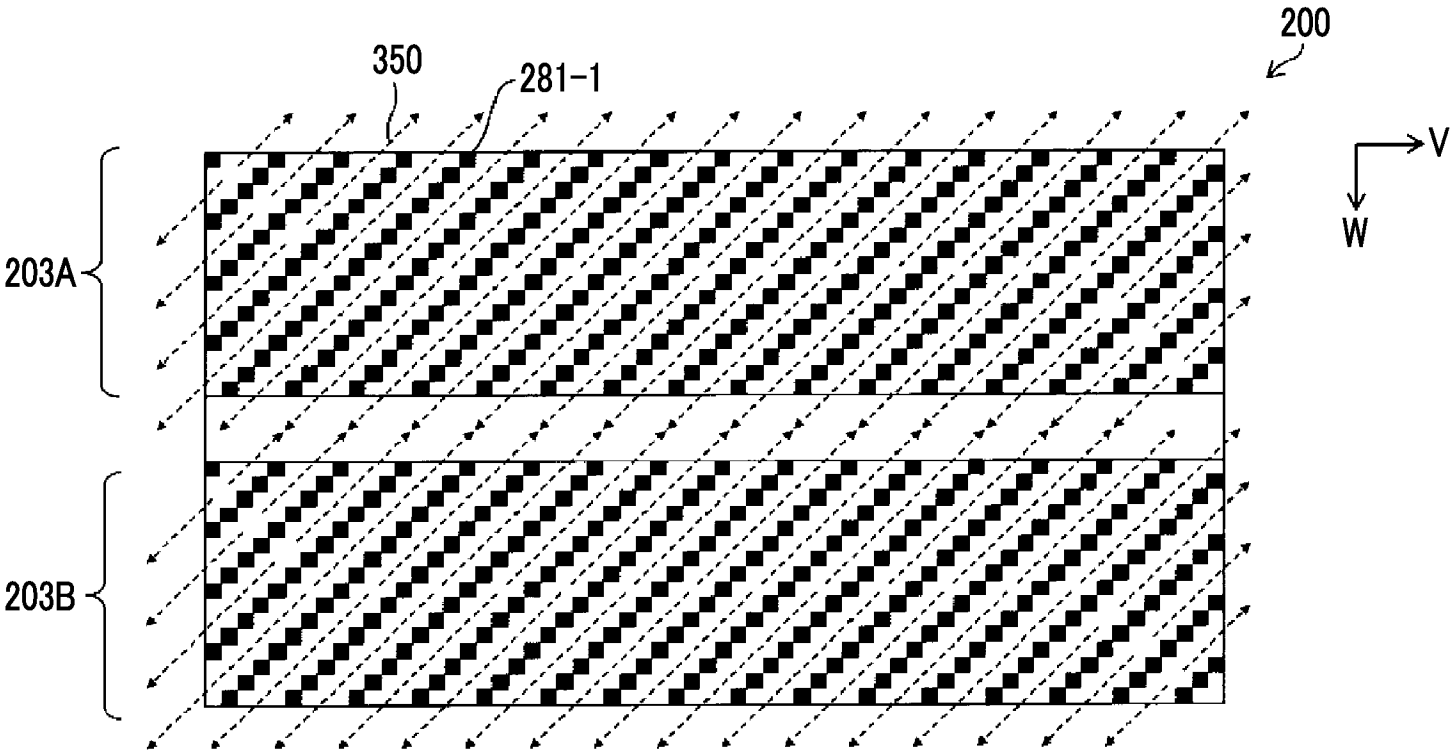
FIG. 19 is a diagram illustrating the effect of the division driving ejection during the dummy jet.

FIG. 19 is a diagram illustrating the effect of the division driving ejection to which the first to fourth groups illustrated in FIGS. 8 to 11 are applied. FIG. 19 illustrates only the first group. In FIG. 19, the same or similar portions as those in FIGS. 8 to 11 are denoted by the same reference numerals and the description thereof will not be repeated.

When ink is ejected from the nozzle portions 281-1 which are arranged in a direction which is inclined with respect to the V direction and the W direction at the same time, the flow of air which pushes mist in a direction represented by an arrow line in FIG. 19 occurs. The flow of air pushes the mist from a portion immediately below the ink ejection surface 277 to the outside of the ink ejection surface 277.

As illustrated in FIGS. 18A to 18D, when ink is ejected from the nozzle portions 281-1 which are arranged in the V direction at the same time, the flow of air which pushes out mist does not occur since the length of a row of the nozzle portions 281-1 is too large. Therefore, floating mist is not pushed from the portion immediately below the ink ejection surface 277 to the outside of the ink ejection surface 277 and a large amount of mist is attached to the ink ejection surface 277.

[Description of Control Flow of Dummy Jet]

Figure 20:
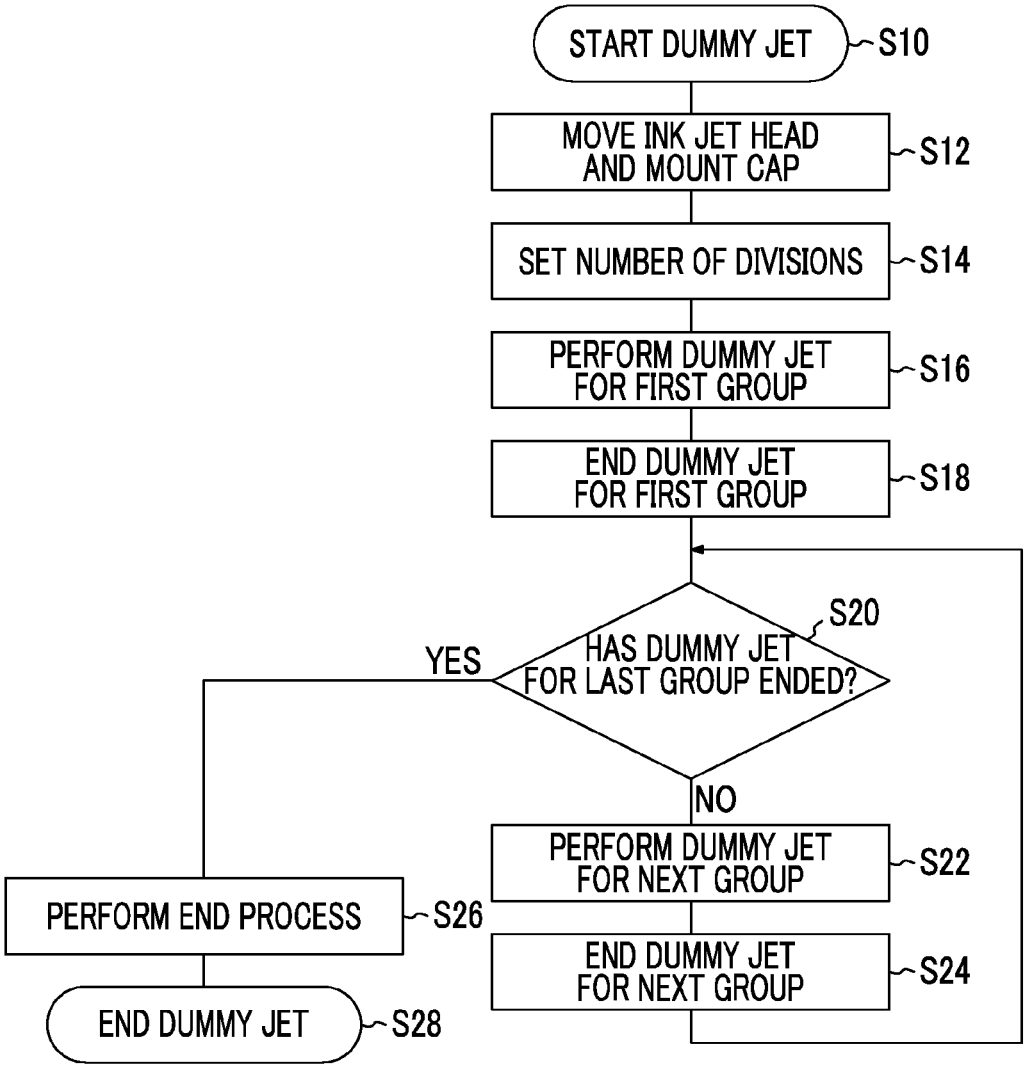
FIG. 20 is a flowchart illustrating the control flow of the dummy jet.

FIG. 20 is a flowchart illustrating the control flow of a dummy jet method according to this example. When the dummy jet starts (Step S10) and the ink jet head 56 is at the image recording position (see FIG. 7), the ink jet head 56 is moved to the maintenance position (Step S12). When the ink jet head 56 is at the maintenance position, the standby cap portion 92 is mounted to the ink jet head 56 (Step S12).

Then, the number of divisions is set (Step S14) and the dummy jet is performed for the first group (Step S16). The number of divisions may be set at the same time as a dummy jet start command or may be a fixed value.

When the dummy jet for the first group ends (Step S18), it is determined whether the group subjected to the dummy jet process is the last group (Step S20). After the dummy jet for the first group ends, the dummy jet is performed for the second group. Therefore, the process proceeds to Step S22 (the determination result is "No") and the dummy jet is performed for the second group (next group).

Then, when the dummy jet for the second group ends (Step S24), the process proceeds to Step S20. This loop is repeated until the dummy jet for the last group ends.

When the dummy jet for the last group ends (the determination result in Step S20 is "Yes"), a dummy jet end process is performed (Step S26) and the dummy jet ends (Step S28).

According to the ink jet recording device and the dummy jet method having the above-mentioned structure, in the ink jet head 56 (head module 200) in which the nozzle portions 281 are arranged in a matrix, the nozzle portions 281 are divided into two or more groups. In the arrangement of the nozzle portions 281, the nozzle portions 281 which are adjacent to each other in the row direction belong to different groups or the nozzle portions 281 which are adjacent to each other in the row direction and the column direction belong to different groups.

The dummy jet is performed for each group. The dummy jet is performed for only one group for one ejection period.

The nozzle portions 281 belonging to the same group are arranged at an interval of at least two nozzles. In the space between the ink ejection surface 277 and the liquid level 92A, since the descending air current region 336 which is generated immediately below the nozzle opening 280 is distant from the ascending air current region 338 generated between the nozzle openings 280, the probability of floating mist landing on the liquid level 92A increases.

In addition, the occurrence of crosstalk between the nozzle portions belonging to the same group is suppressed and the ejection of ink is stabilized. Therefore, the generation of mist is suppressed.

The ejection frequency of the dummy jet is in the range of 10 kHz or more and is determined so as to avoid the ejection frequency which is affected by crosstalk. Therefore, the ejection of ink is stabilized in the dummy jet and the generation of mist, which has not been completely prevented by the structure in which the nozzle portions 281 that eject ink at the same time are separated from each other, is prevented.

The ejection frequency increases to continuously generate an air current from the ink ejection surface 277 to the liquid level 92A. Therefore, even when mist is generated, it is possible to land the mist on the liquid level 92A and thus to reduce the amount of mist moving to the ink ejection surface 277.

[Description of Other Aspects of Dummy Jet]

Next, other aspects of the division driving ejection in the dummy jet of the ink jet head 56 (head module 200) will be described.

<Description of Problems>

Figure 21:
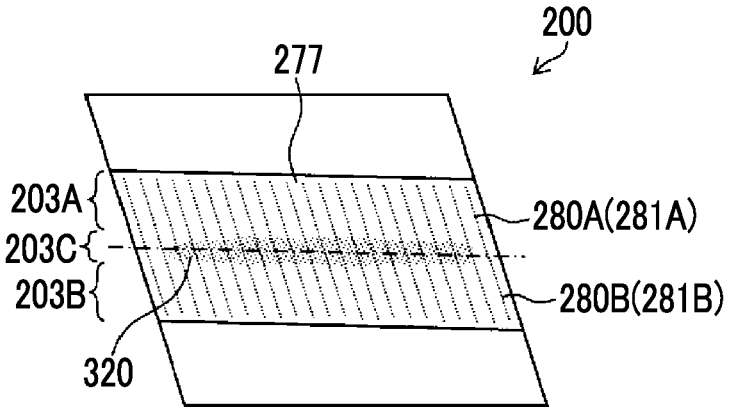
FIG. 21 is a diagram illustrating a technical problem of the dummy jet.

FIG. 21 is a diagram illustrating technical problems in the dummy jet and illustrates a state in which the mist 320 is attached to the ink ejection surface 277 of the head module 200. In the head module 200 illustrated in FIG. 21, a gap portion 203C in which the nozzle opening 280 is not formed is provided at the center in the lateral direction (the W direction or the Y direction in FIG. 5).

During the dummy jet of the ink jet head 56 including the head module 200 in which the gap portion 203C was provided between the first block 203A and the second block 203B, it was proved that the amount of mist 320 beyond the allowable range was attached to the gap portion 203C when ink was ejected from the first block 203A and the second block 203B at the same time.

Figure 22:
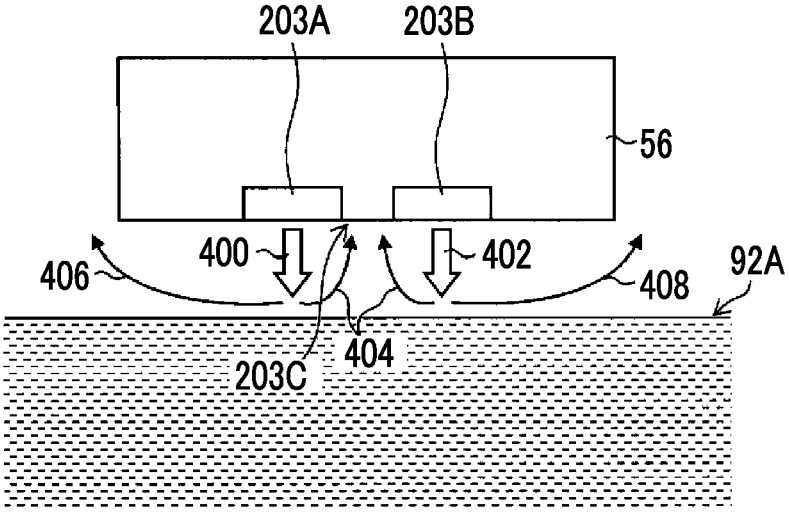
FIG. 22 is a diagram schematically illustrating a state between an ink ejection surface 277 and a liquid level 92A during the dummy jet.

FIG. 22 is a diagram schematically illustrating a state between the ink ejection surface 277 and the liquid level 92A during a dummy jet. As described above, a descending composite air current from the ink ejection surface 277 to the liquid level 92A is generated due to the ejection of ink.

The composite air current is a composite air current of a descending air current 400 caused by the ejection of ink from the first block 203A and a descending air current 402 caused by the ejection of ink from the second block 203B.

Since atmospheric pressure in a region between the first block 203A and the second block 203B is lower than that in other regions, an ascending air current 404 from the liquid level 92A to the ink ejection surface 277 is generated.

Then, mist which floats without being attached to the liquid level 92A moves on the ascending air current 404 and is then attached to the gap portion 203C of the ink ejection surface 277.

In contrast, an air current 406 from the first block 203A to the outside and an air current 408 from the second block 203B to the outside reach the outside of the head module 200 through a space between the ink ejection surface 277 and the liquid level 92A.

Since mist on the air currents 406 and 408 moves to the outside of the head module 200, no mist is attached to the outer edge of the ink ejection surface 277.

Figure 23A:
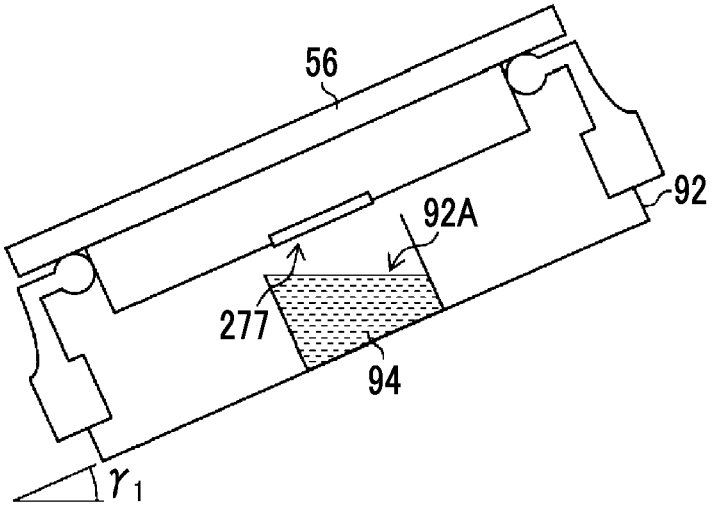
FIGS. 23A and 23B are diagrams illustrating another technical problem of the dummy jet.
Figure 23B:
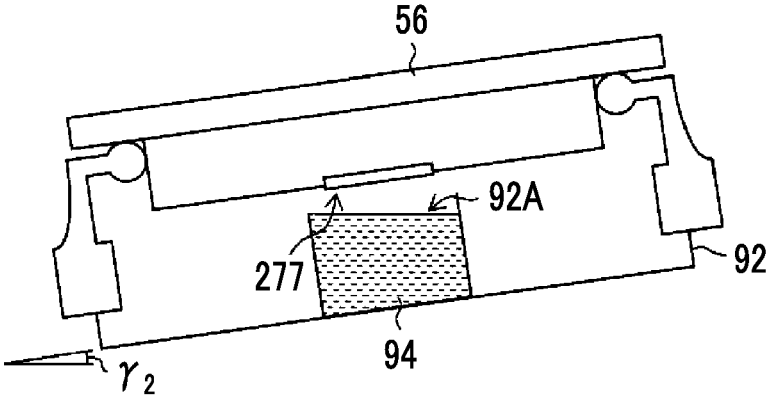

FIGS. 23A and 23B are diagrams illustrating another technical problem of the dummy jet and schematically illustrate a state in which the standby cap portion 92 is mounted to the ink jet head 56.

FIG. 23A illustrates a state in which the ink jet head 56 is inclined at an angle $\gamma 1$ with respect to the horizontal plane. FIG. 23B illustrates a state in which the ink jet head 56 is inclined at an angle $\gamma 2$ ($<\gamma 1$) with respect to the horizontal plane.

In the ink jet recording device 10 illustrated in FIG. 1, $\gamma 1$ is 24° and $\gamma 2$ is 8°.

In the ink jet recording device 10 illustrated in FIG. 1, four ink jet heads 56C, 56M, 56Y, and 56K corresponding to C, M, Y, and K are arranged along the outer circumferential surface of the image forming drum 52 at a constant distance from the outer circumferential surface of the image forming drum 52.

According to this structure, the inclination angle of two outer ink jet heads 56C and 56K with respect to the horizontal plane is greater than the inclination angle of two inner ink jet heads 56M and 56Y with respect to the horizontal plane.

FIG. 23A illustrates a state in which the standby cap portion 92 is mounted to the ink jet head 56 which is inclined at a relatively large angle with respect to the horizontal plane and FIG. 23B illustrates a state in which the standby cap portion 92 is mounted to the ink jet head 56 which is inclined at a relatively small angle with respect to the horizontal plane.

It was proved that, in the ink jet head 56 illustrated in FIG. 23A which was inclined at a relatively large angle with respect to the horizontal plane, the amount of mist attached to the gap portion 203C of the ink ejection surface 277 during the dummy jet was more than that in the ink jet head 56 illustrated in FIG. 23B which was inclined at a relatively small angle with respect to the horizontal plane.

Other aspects of the division driving ejection in the dummy jet for solving the above-mentioned technical problems will be described in detail below.

<Description of Other Aspects of Division Driving Ejection>

FIGS. 24 to 27 are diagrams illustrating other aspects of the division driving ejection in the dummy jet. In the following description, the same or similar portions as those described above are denoted by the same reference numerals and the description thereof will not be repeated.

In the division driving ejection in the dummy jet which will be described below, the dummy jet is sequentially performed for each group. When the dummy jet is performed for each group, the dummy jet is sequentially performed for each block.

Figure 24:
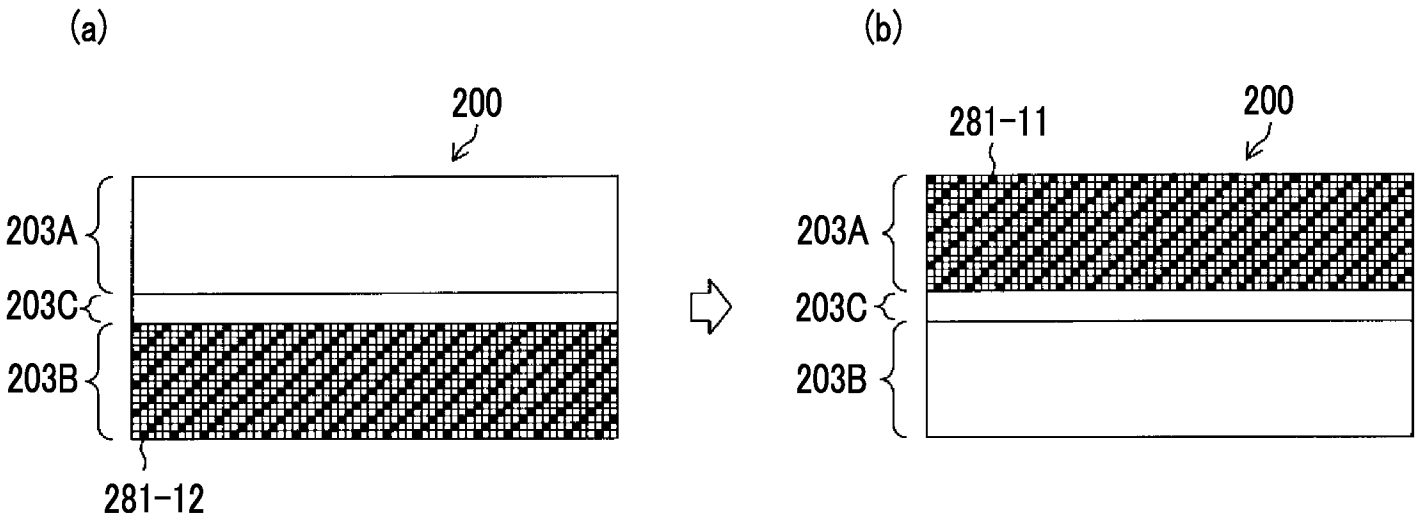
FIG. 24 is a diagram illustrating another aspect of the division driving ejection during the dummy jet: (a) illustrates nozzle portions belonging to a second block of a first group; and (b) illustrates nozzle portions belonging to a first block of the first group.

That is, a dummy jet is performed for a nozzle portion 281-12 belonging to a second block 203B ($G_1B_2$) of the first group illustrated in (a) of FIG. 24. When the dummy jet for the nozzle portion 281-12 belonging to the second block 203B of the first group ends, the dummy jet is performed for a nozzle portion 281-11 belonging to a first block 203A ($G_1B_1$) of the first group illustrated in (b) of FIG. 24.

Figure 25:
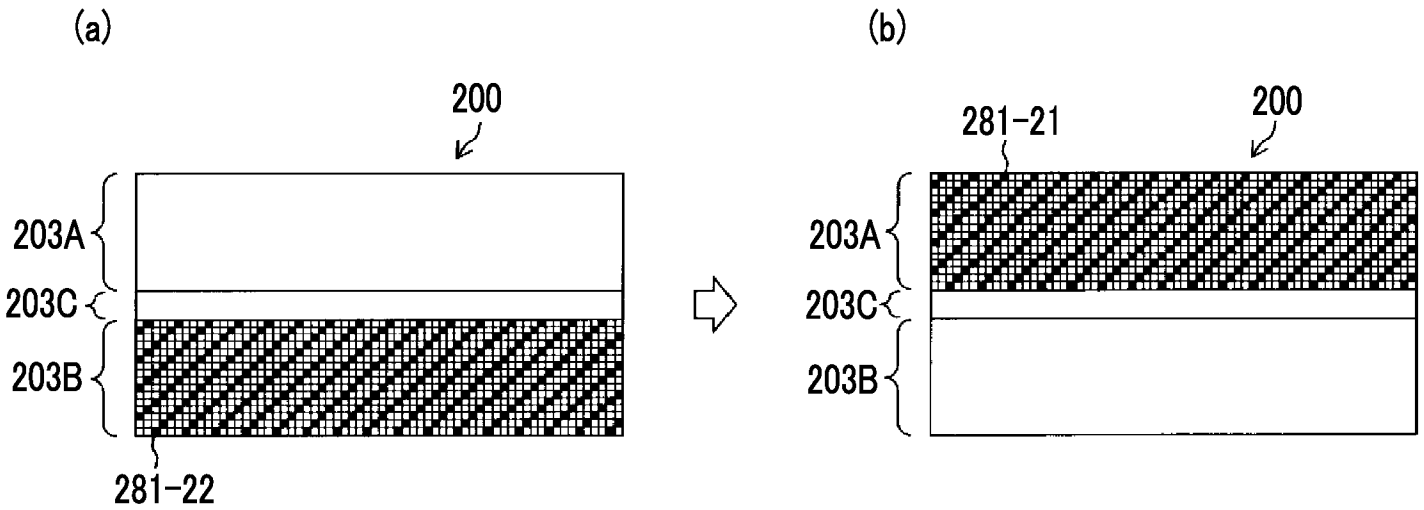
FIG. 25 is a diagram illustrating another aspect of the division driving ejection during the dummy jet: (a) illustrates nozzle portions belonging to a second block of a second group; and (b) illustrates nozzle portions belonging to a first block of the second group.

When the dummy jet for the nozzle portion 281-11 belonging to the first block 203A of the first group ends, the dummy jet is performed for a nozzle portion 281-22 belonging to a second block 203B ($G_2B_2$) of the second group illustrated in (a) of FIG. 25.

Figure 26:
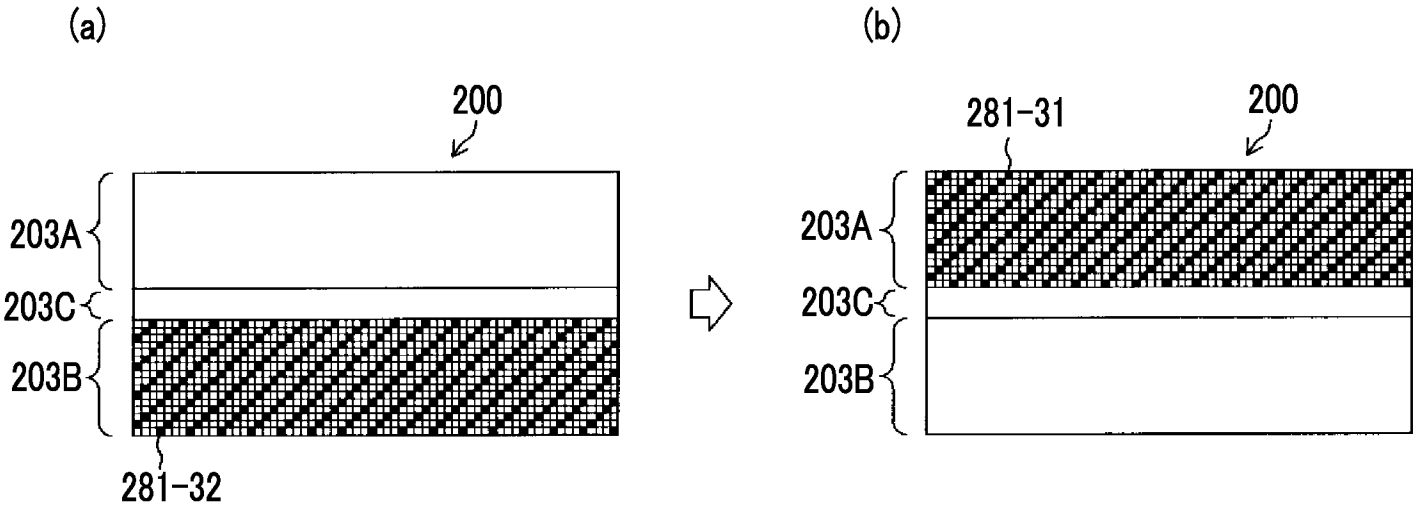
FIG. 26 is a diagram illustrating another aspect of the division driving ejection during the dummy jet: (a) illustrates nozzle portions belonging to a second block of a third group; and (b) illustrates nozzle portions belonging to a first block of the third group.
Figure 27:
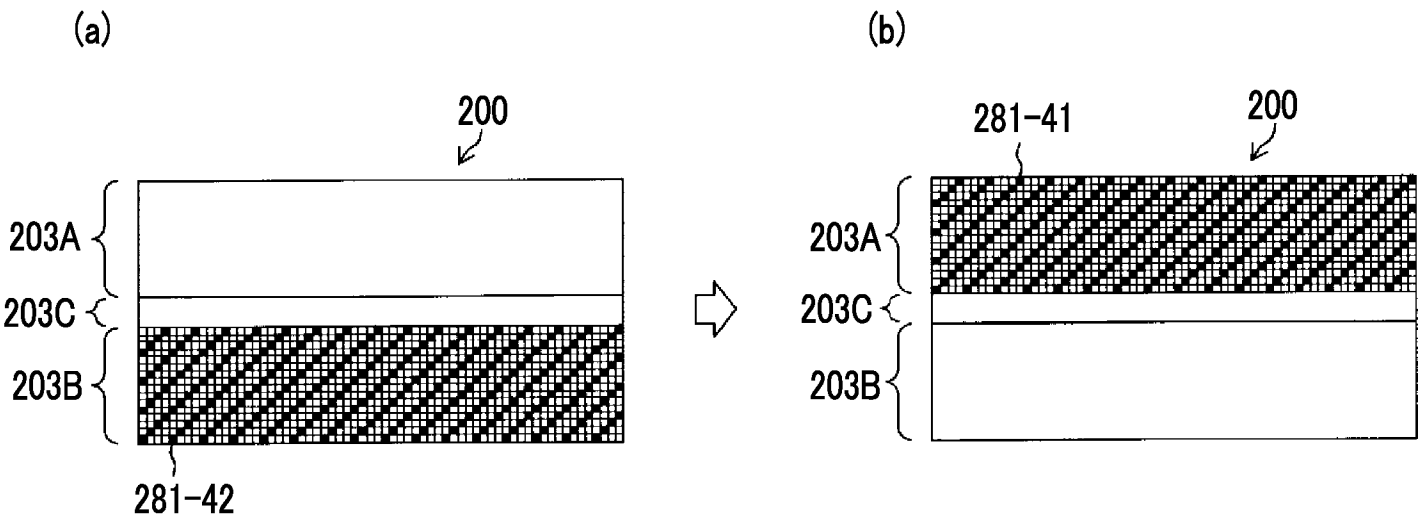
FIG. 27 is a diagram illustrating another aspect of the division driving ejection during the dummy jet: (a) illustrates nozzle portions belonging to a second block of a fourth group; and (b) illustrates nozzle portions belonging to a first block of the fourth group.

Then, the dummy jet for a nozzle portion 281-21 belonging to a first block 203A ($G_2B_1$) of the second group illustrated in (b) of FIG. 25, the dummy jet for a nozzle portion 281-32 belonging to a second block 203B ($G_3B_2$) of the third group illustrated in (a) of FIG. 26, the dummy jet for a nozzle portion 281-31 belonging to a first block 203A ($G_3B_1$) of the third group illustrated in (b) of FIG. 26, the dummy jet for a nozzle portion 281-42 belonging to a second block 203B ($G_4B_2$) of the fourth group illustrated in (a) of FIG. 27, and the dummy jet for a nozzle portion 281-41 belonging to a first block 203A ($G_4B_1$) of the fourth group illustrated in (b) of FIG. 27 are sequentially performed after the dummy jet for the block of the previous group ends.

The execution order of the dummy jet can be appropriately changed. For example, after the dummy jet is sequentially performed for the first blocks of the first to fourth groups, the dummy jet may be sequentially performed for the second blocks of the first to fourth groups.

The ejection driving voltage for ejecting ink from the nozzle portion 281 is supplied to the piezoelectric elements 230 (see FIG. 6) corresponding to the nozzle portions 281 belonging to the block and the group for which the dummy jet will be performed. The non-ejection driving voltage for preventing ink from being ejected is supplied to the piezoelectric elements corresponding to the nozzle portions 281 belonging to the block (group) for which the dummy jet will not be performed.

<Description of Effect>

FIGS. 28A to 28C, FIG. 29, and FIGS. 31A to 31C are diagrams illustrating the effect of the dummy jet in which the division driving ejection is applied to each block.

The dummy jet was performed for all of the head modules 200 forming the ink jet head under the following conditions and the ink ejection surface 277 of each head module 200 was visually inspected to check the attachment state of mist.

As a comparative example, in a case in which the head module was not divided and ink was ejected from all of the nozzles of all of the head modules 200 at the same time to perform a dummy jet and a case in which all of the head modules 200 were divided into four groups and ink was ejected from the first and second blocks in the same group at the same time to perform a dummy jet, the ink ejection surface 277 was visually inspected to check the attachment state of mist.

The ejection conditions were as follows:

The number of nozzles per head module: 2048 nozzles;

The number of divisions: 8 (256 nozzles) (four groups× two blocks);

The number of dummy jets (the number of ejections): 20000;

Ejection frequency: 25 kHz

The amount of ink ejected by one ejection operation: 9 picoliters;

The distance between the ink ejection surface and the liquid level: 3.4 millimeters; and The angle of the ink ejection surface with respect to the horizontal plane: 24°.

Figure 28A:
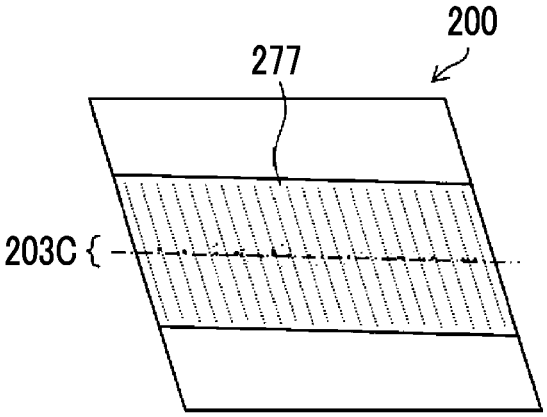
FIGS. 28A to 28C are diagrams illustrating the effect of the dummy jet to which division driving ejection performed for each block is applied.
Figure 28B:
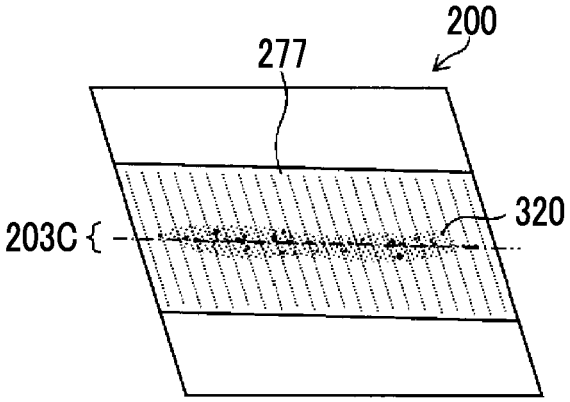
Figure 28C:
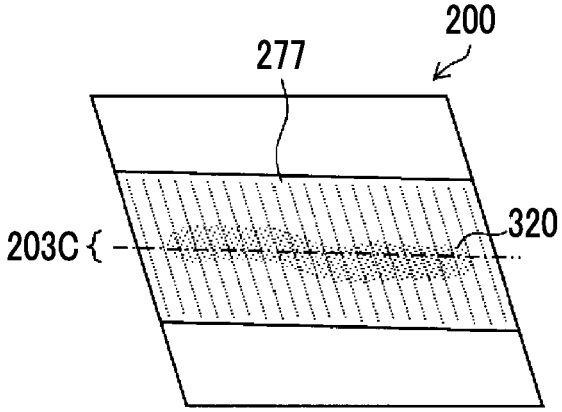

FIG. 28A is a diagram schematically illustrating the state of the ink ejection surface 277 after the dummy jet is performed in the case in which the number of divisions is 8. FIG. 28B is a diagram schematically illustrating the state of the ink ejection surface 277 when there is no division. FIG. 28C is a diagram schematically illustrating the state of the ink ejection surface 277 after the dummy jet is performed in the case in which the number of divisions is 4.

When the number of divisions is 8 as illustrated in FIG. 28A, the amount of mist attached to the ink ejection surface 277 is so small that the mist is invisible.

In contrast, when there is no division as illustrated in FIG. 28B, a large amount of mist is attached to the gap portion 203C of the ink ejection surface 277 and a plurality of mist droplets are combined into a large droplet. In addition, when the number of divisions is 4 as illustrated in FIG. 28C, the amount of mist attached to the entire ink ejection surface 277 is less than that when there is no division, but the amount of mist attached to the gap portion 203C is more than that when the number of divisions is 8.

Figure 29:
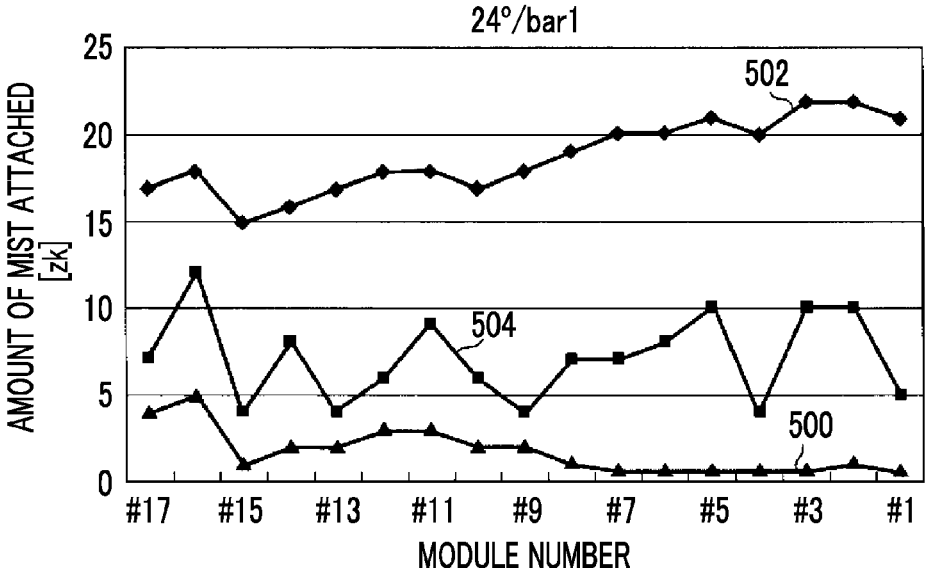
FIG. 29 is a diagram illustrating the attachment state of mist to an ink ejection surface 277 in each module.

FIG. 29 is a graph in which the attachment state of mist to the ink ejection surface 277 of each of the head modules 200 forming the ink jet head 56 (bar1) is represented by a value of 0 to 25 (zk).

In FIG. 29, a value having # attached thereto indicates the number (position) of the head module 200. A zk value "0" indicates a state in which mist is not visibly recognized. As the zk value increases, the amount of mist attached increases.

When the number of divisions is 8, which is represented by reference numeral 500 in FIG. 29, the zk value is equal to or less than 5 in all of the head modules 200. The average of the zk values in all of the head modules 200 is 1.7.

In contrast, when there is no division, which is represented by reference numeral 502 in FIG. 29, the zk value is equal to or greater than 15 in all of the head modules 200 and the amount of mist attached is more than that when the number of divisions is 8.

When the number of divisions is 4, which is represented by reference numeral 504 in FIG. 29, the zk value is equal to or greater than 4 and equal to or less than 12 and the amount of mist attached in all of the head module 200 is more than that when the number of divisions is 8.

Next, the results when the same verification as described above is performed using another ink jet head 56 (bar2) will be described.

Figure 30A:
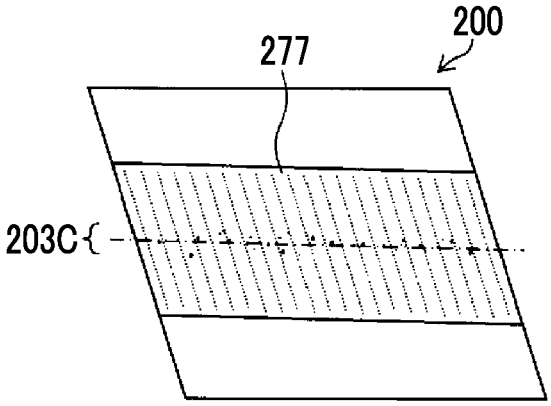
FIGS. 30A to 30C are diagrams illustrating the effect of a dummy jet to which division driving ejection performed for each block is applied in another ink jet head.
Figure 30B:
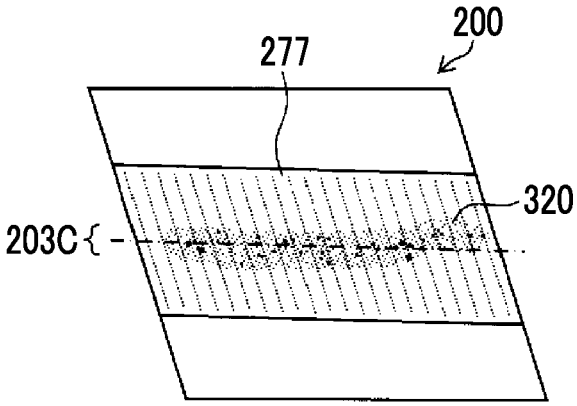
Figure 30C:
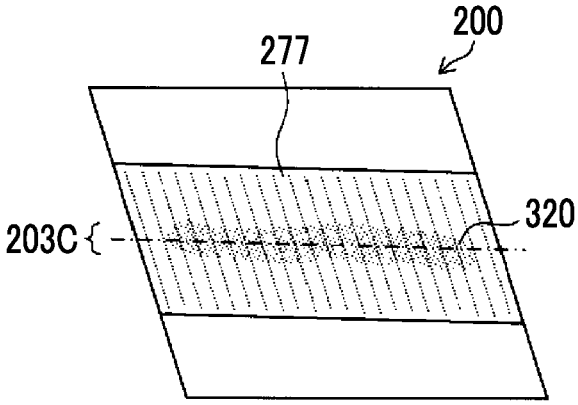

FIG. 30A is a diagram schematically illustrating the state of the ink ejection surface 277 after a dummy jet when the number of divisions is 8. FIG. 30B is a diagram schematically illustrating the state of the ink ejection surface 277 after a dummy jet when there is no division. FIG. 30C is a diagram schematically illustrating the state of the ink ejection surface 277 after a dummy jet when the number of divisions is 4.

When the number of divisions is 8 as illustrated in FIG. 30A, mist attached to the ink ejection surface 277 is not seen.

In contrast, when there is no division as illustrated in FIG. 30B, a large amount of mist 320 is attached to the gap portion 203C of the ink ejection surface 277 and a large droplet, which is a combination of a plurality of mist droplets, is seen. In addition, when the number of divisions is 4 as illustrated in FIG. 30C, the amount of mist 320 attached to the gap portion 203C of the ink ejection surface 277 is more than that when the number of divisions is 8.

Figure 31:
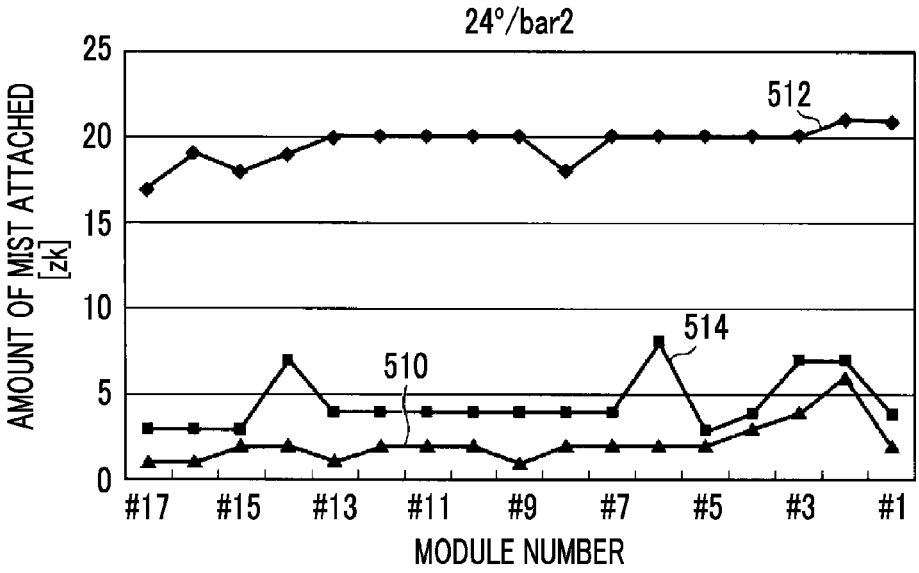
FIG. 31 is a diagram illustrating the attachment state of mist to an ink ejection surface 277 in each module of another ink jet head.

FIG. 31 is a graph in which the attachment state of mist to the ink ejection surface 277 of each module is represented by a value of 0 to 25 (zk) and corresponds to FIG. 29. When the number of divisions is 8, which is represented by reference numeral 510 in FIG. 31, the zk value indicating the attachment state of mist is less than that when there is no division, which is represented by reference numeral 512, and when the number of divisions is 4, which is represented by reference numeral 514, in all of the head modules 200.

Figure 32:
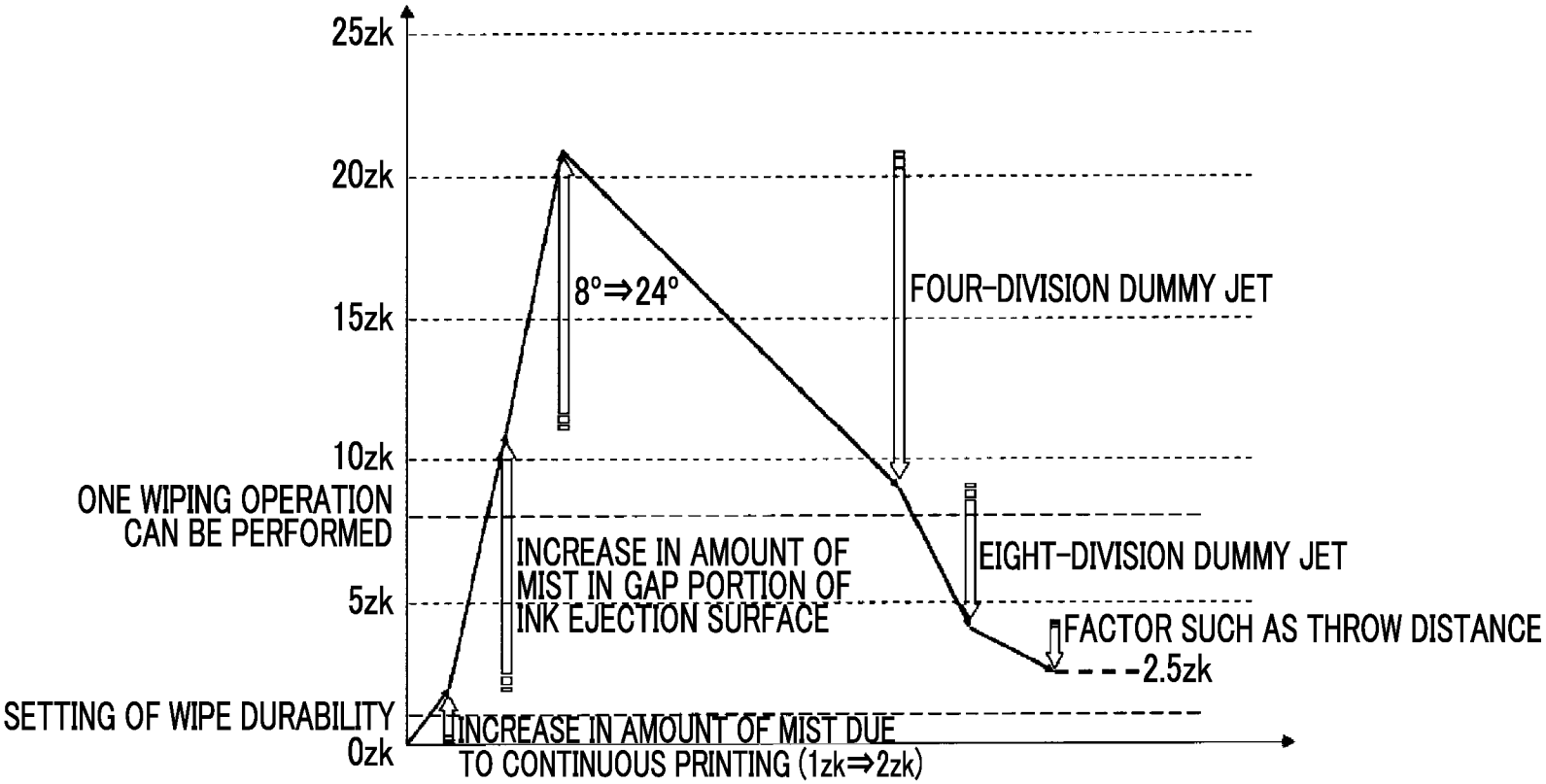
FIG. 32 is a diagram illustrating the correlation between a factor for an increase in the amount of mist attached to the ink ejection surface 277 and a factor for a decrease in the amount of mist attached to the ink ejection surface 277.

FIG. 32 is a diagram illustrating the correlation between a factor for an increase in the amount of mist attached to the ink ejection surface 277 and a factor for a decrease in the amount of mist attached thereto.

For the factor for the increase, the amount of mist attached to the gap portion 203C (see FIG. 21) of the ink ejection surface 277 is increased by the dummy jet which ejects ink from all of the nozzle openings 280 at the same time. In this case, the zk value is increased by about 10. In addition, the zk value is increased by about 10 with an increase in the inclination angle of the ink ejection surface with respect to the horizontal plane.

In contrast, for the factor for the decrease, when four-division driving ejection is applied in the dummy jet, the zk value is decreased by about 10 to 15. In addition, when eight-division driving ejection is applied, the zk value is further decreased by about 5.

The zk value is expected to be decreased by about 1 to 2 due to other factors, such as the throw distance between the ink ejection surface 277 and the liquid level 92A.

The zk value of the amount of mist which can be removed by one wiping operation (one cleaning operation) is about 8. The zk value of the amount of mist which is allowed when the abrasion of a liquid-repellent film by carbon black is considered is about 1.

In this example, one gap portion 203C in which the nozzle opening 280 (nozzle portion 281) is not provided is provided on the ink ejection surface 277. However, the division driving ejection for each block may be applied to an ink jet head 56 (head module 200) in which two or more gap portions 203C are provided on the ink ejection surface 277.

For example, when two gap portions 203C are provided, the nozzle openings 280 (nozzle portions 281) are divided into three blocks, and the nozzle portions 281 which are supplied with ink from the same supply flow path are divided into four groups, the dummy jet is performed as follows: the dummy jet is performed for a first block ($G_1B_1$) of a first group; after the dummy jet for the first block of the first group ends, the dummy jet is performed for a second block of the first group; and after the dummy jet for the second block ($G_1B_2$) of the first group ends, the dummy jet is performed for a third block ($G_1B_3$) of the first group.

Then, the dummy jet is sequentially performed for a first block ($G_2B_1$) of a second group, a second block ($G_2B_2$) of the second group, a third block ($G_2B_3$) of the second group, a first block ($G_3B_1$) of a third group, a second block ($G_3B_2$) of the third group, a third block ($G_3B_3$) of the third group, a first block ($G_4B_1$) of a fourth group, a second block ($G_4B_2$)

of the fourth group, and a third block ($G_4B_3$) of the fourth group. In addition, the execution order of the dummy jet can be appropriately changed.

That is, in the dummy jet for an ink jet head in which the nozzle portions that are supplied with ink from the same supply flow path are divided into p groups (p is an integer equal to or greater than 2) and the nozzle portions 281 are divided into q blocks (q is an integer equal to or greater than 2) by (q−1) gap portions formed on the ink ejection surface 277, p×q-division driving ejection is performed from a first block ($G_1B_1$) of a first group to a q-th block ($G_pB_q$) of a p-th group.

According to other aspects of the above-mentioned ink jet recording device and dummy jet method, in a dummy jet for an ink jet head 56 in which the nozzle portions 281 are arranged in a matrix and the gap portion 203C is provided at the center in the lateral direction, the dummy jet is performed for the first block 203A which is arranged on one side of the gap portion 203C in the lateral direction. After the dummy jet for the first block ends, the dummy jet is performed for the second block 203B on the other side. According to this structure, it is possible to reduce the amount of mist attached to the gap portion 203C during the dummy jet.

In a block for which the dummy jet is not performed, the non-ejection driving voltage is supplied to the piezoelectric elements 230 corresponding to the nozzle portion 281 in the block. The "non-ejection driving voltage" may include a meniscus micro-vibration voltage for vibrating a meniscus to such an extent that ink is not ejected from the nozzle portion 281 and a voltage which does not operate the piezoelectric element 230 (non-application of the driving voltage).

<Description of Mask Applied to Division Driving Ejection>

Figure 33:
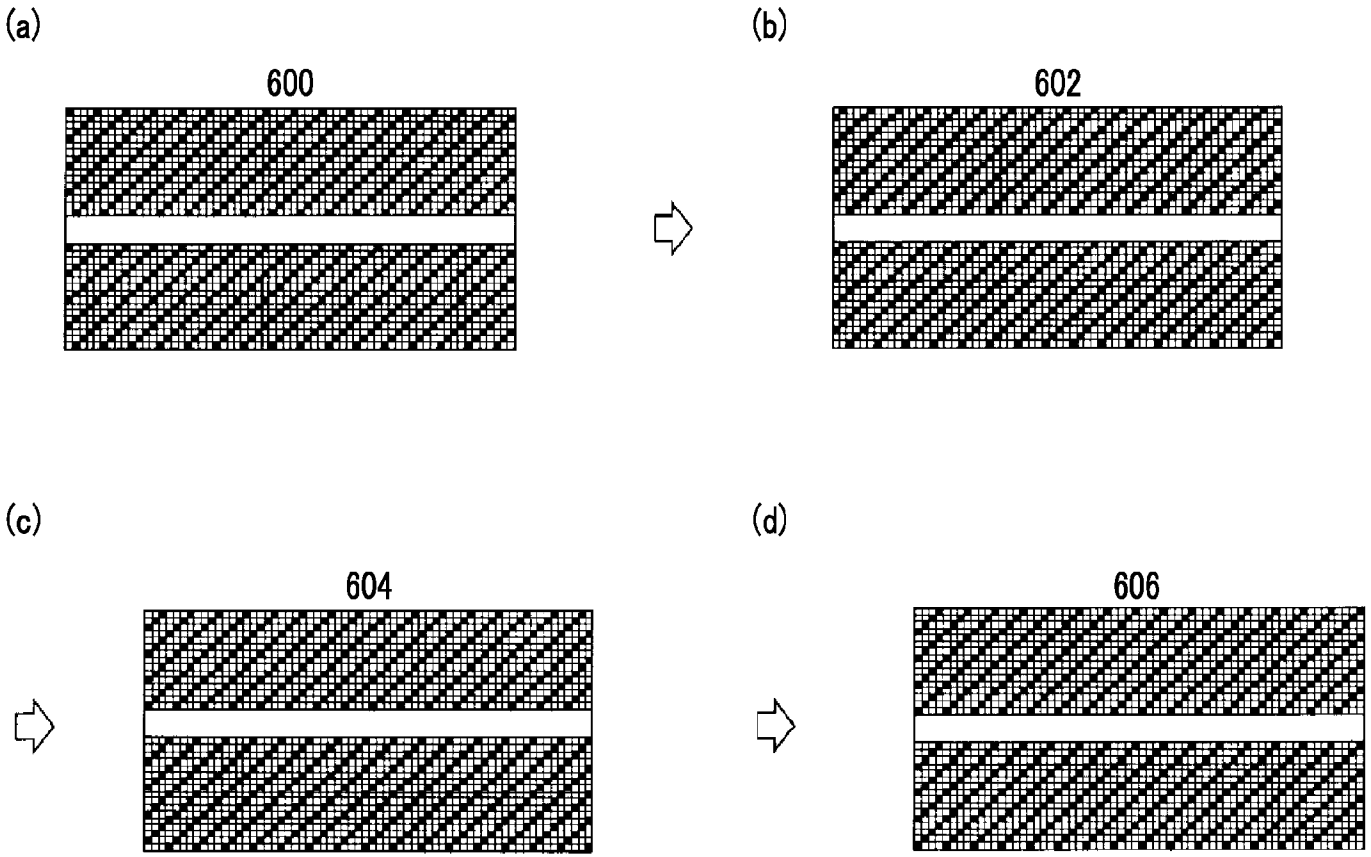
FIG. 33 is a diagram schematically illustrating masks applied to four-division driving ejection: (a) illustrates a mask corresponding to nozzle portions in a first group; (b) illustrates a mask corresponding to nozzle portions in a second group; (c) illustrates a mask corresponding to nozzle portions in a third group; and (d) illustrates a mask corresponding to nozzle portions in a fourth group.

(a) to (d) of FIG. 33 are diagrams schematically illustrating a mask which is applied to four-division driving ejection in the dummy jet. An A mask 600 illustrated in (a) of FIG. 33 corresponds to the nozzle portions 281-1 of the first group illustrated in FIG. 8.

A B mask 602 illustrated in (b) of FIG. 33, a C mask 604 illustrated in (c) of FIG. 33, and a D mask 606 illustrated in (d) of FIG. 33 correspond to the nozzle portions 281-2 illustrated in FIG. 9, the nozzle portions 281-3 illustrated in FIG. 10, and the nozzle portions 281-4 illustrated in FIG. 11, respectively.

The A mask 600, the B mask 602, the C mask 604, and the D mask 606 illustrated in (a) to (d) of FIG. 33 are generated in advance and are stored in, for example, the ROM 100B illustrated in FIG. 2.

When the dummy jet is performed, the masks are switched in correspondence with the switching between the groups.

Figure 34:
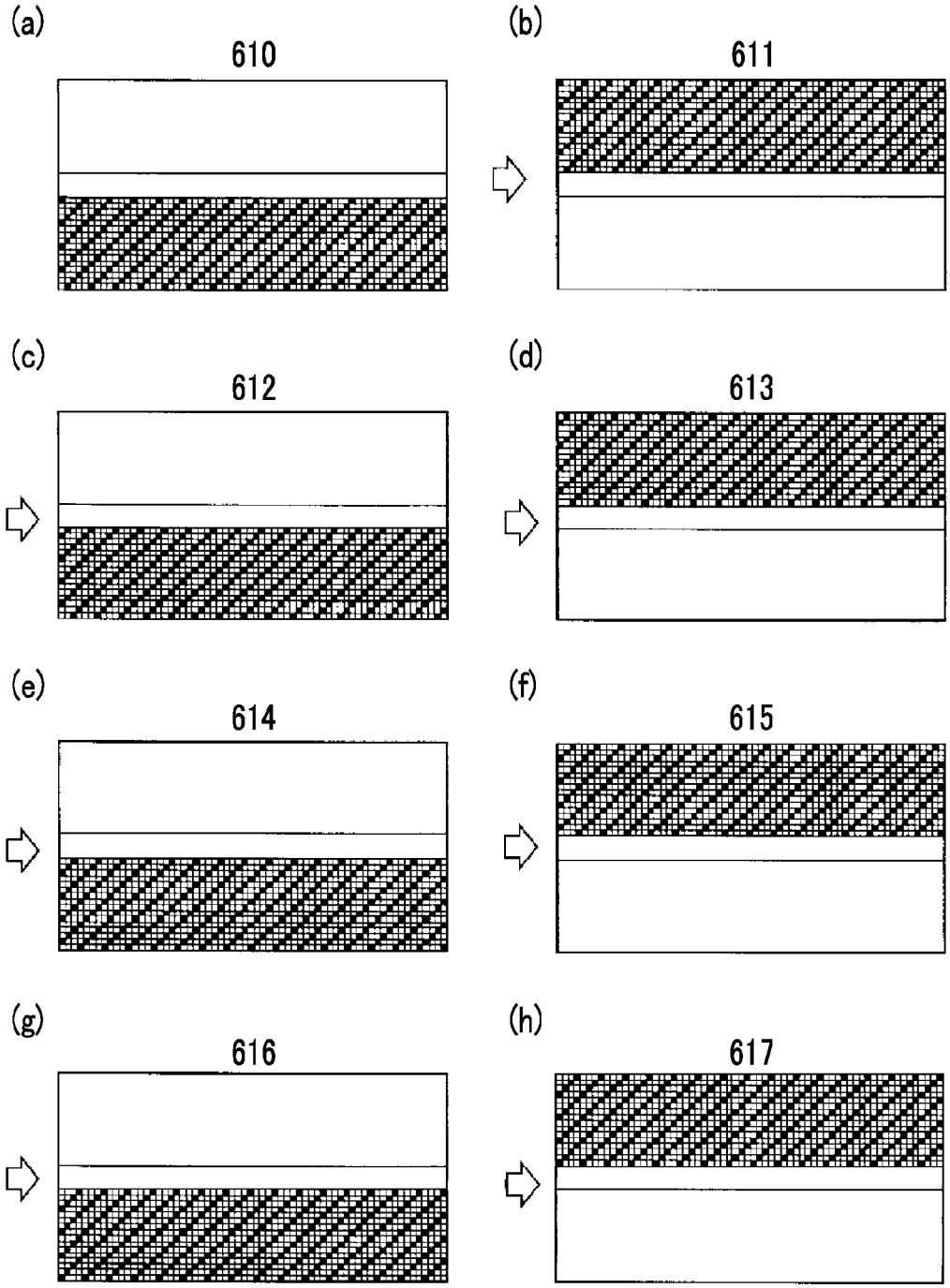
FIG. 34 is a diagram schematically illustrating masks applied to eight-division driving ejection: (a) illustrates a mask corresponding to nozzle portions in a second block of a first group; (b) illustrates a mask corresponding to nozzle portions in a first block of the first group; (c) illustrates a mask corresponding to nozzle portions in a second block of a second group; (d) illustrates a mask corresponding to nozzle portions in a first block of the second group; (e) illustrates a mask corresponding to nozzle portions in a second block of a third group; (f) illustrates a mask corresponding to nozzle portions in a first block of the third group; (g) illustrates a mask corresponding to nozzle portions in a second block of a fourth group; and (h) illustrates a mask corresponding to nozzle portions in a first block of the fourth group.

(a) to (h) of FIG. 34 are diagrams schematically illustrating masks applied to eight-division driving ejection in the dummy jet. An $A_1$ mask 610 illustrated in (a) of FIG. 34 corresponds to the nozzle portions 281-12 in the second block ($G_1B_2$) of the first group illustrated in (a) of FIG. 24 and an $A_2$ mask 611 illustrated in (b) of FIG. 34 corresponds to the nozzle portions 281-11 in the first block ($G_1B_1$) of the first group illustrated in (b) of FIG. 24.

A $B_1$ mask 612 illustrated in (c) of FIG. 34 corresponds to the nozzle portions 281-22 in the second block ($G_2B_2$) of the second group illustrated in (a) of FIG. 25 and a $B_2$ mask 613 illustrated in (d) of FIG. 34 corresponds to the nozzle portions 281-21 in the first block ($G_2B_1$) of the second group illustrated in (b) of FIG. 25.

Similarly, a $C_1$ mask 614 illustrated in (e) of FIG. 34 corresponds to the nozzle portions 281-32 in the second block ($G_3B_2$) of the third group illustrated in (a) of FIG. 26 and a $C_2$ mask 615 illustrated in (f) of FIG. 34 corresponds to the nozzle portions 281-31 in the first block ($G_3B_1$) of the third group illustrated in (b) of FIG. 26. A $D_1$ mask 616 illustrated in (g) of FIG. 34 corresponds to the nozzle portions 281-42 in the second block ($G_4B_2$) of the fourth group illustrated in (a) of FIG. 26 and a $D_2$ mask 617 illustrated in (h) of FIG. 34 corresponds to the nozzle portions 281-41 in the first block ($G_4B_1$) of the fourth group illustrated in (b) of FIG. 27.

That is, p×q masks M(p, q) (where p is the number of groups and q is the number of blocks) are created and stored. When the dummy jet is performed, necessary masks M(p, q) are read according to the setting (p, q) of the number of groups p and the number of blocks q. The read masks M(p, q) are switched in correspondence with the switching between the blocks ($G_pB_q$) of the groups.

In the eight-division driving ejection, p is an integer equal to or greater than 2. However, p may be an integer equal to or greater than 1, considering four-division driving ejection (in the case of one block).

A program which causes a computer to perform each process of the above-mentioned dummy jet method may be stored in a non-transitory storage medium. When the dummy jet is performed, the program may be read and executed.

In the above-mentioned ink jet recording device and dummy jet method for an ink jet head, components can be appropriately changed, added, or removed without departing from the scope and spirit of the invention. In addition, the above-mentioned structural examples can be appropriately combined with each other.

In the specification, the ink jet recording device is given as an example of the structure of the device to which the ink jet head driving system is applied. However, the invention can be widely applied to liquid ejection devices other than the ink jet recording device.

[Invention Disclosed in the Specification]

As can be seen from the description of the embodiments of the invention, the specification includes the disclosure of various technical ideas including at least the following invention.

(First Aspect): A liquid ejection device includes: an ink jet head in which a plurality of nozzle portions are arranged in a matrix in a row direction and a column direction which obliquely intersects the row direction; a plurality of pressurizing elements that are provided so as to correspond to the plurality of nozzle portions and generate an ejection force for ejecting a liquid from the corresponding nozzle portions; and a driving voltage supply unit that supplies a driving voltage to the plurality of pressurizing elements. The ink jet head is provided with supply flow paths for supplying the liquid to the plurality of nozzle portions. The plurality of nozzle portions which are supplied with the liquid from the same supply flow path are divided into two or more groups. The driving voltage supply unit supplies an ejection driving voltage for ejecting the liquid to each of the groups when a dummy jet is performed. During a period of time when the dummy jet is performed for one group, the driving voltage supply unit supplies a non-ejection driving voltage for preventing the liquid from being ejected to the other groups.

According to the first aspect, the plurality of nozzle portions which are supplied with the liquid from the same supply flow path are divided into two or more groups. For the period for which the dummy jet is performed for one group, the non-ejection driving voltage for preventing the liquid from being ejected is supplied to the other groups. Therefore, the nozzle portions which eject the liquid are dispersed. A region in which a descending air current from the liquid ejection surface is generated is widened and a region in which an ascending air current to the liquid ejection surface is generated is narrowed. The probability of mist moving to the region in which the ascending air current is generated is reduced. As a result, the amount of mist moving to the liquid ejection surface is reduced and the attachment of mist to the liquid ejection surface is suppressed.

In an ink jet head having a structure in which a plurality of head modules are connected, the nozzle portions in each head module can be divided into a plurality of groups and a dummy jet can be performed.

The row direction in the arrangement of the nozzle portions may be a direction perpendicular to the relative moving direction of moving means for moving a recording medium relative to the ink jet head or a direction which is inclined with respect to the direction perpendicular to the relative moving direction of the moving means.

The concept of the pressurizing element includes a piezoelectric element which is flexurally deformed according to the driving voltage and a heating element (heater) which heats a liquid according to the driving voltage to generate a film boiling phenomenon.

(Second Aspect): In the liquid ejection device according to the first aspect, among a plurality of nozzle portions arranged in the column direction, the nozzle portions belonging to the same group are arranged at an interval of equal to or more than two nozzles.

According to the second aspect, among the nozzle portions which are supplied with the liquid from the same supply flow path, the nozzle portions belonging to the same group are arranged at an interval of two nozzles or more. Therefore, the influence of crosstalk between the nozzle portions which are supplied with the liquid from the same supply flow path is suppressed and liquid ejection in the dummy jet is stabilized. As a result, the attachment of mist to the liquid ejection surface is suppressed.

(Third Aspect): In the liquid ejection device according to the first or second aspect, the nozzle portions belonging to the same group are arranged at an interval of equal to or more than two nozzles in the row direction and the column direction.

According to the third aspect, the nozzle portions belonging to the same group are arranged in a direction which is inclined with respect to the row direction and the column direction. Therefore, even when the liquid is ejected from the nozzle portions belonging to the same group at the same time, an air flow path is formed according to the arrangement of the nozzle portions in the oblique direction. As a result, it is possible to discharge mist from a portion immediately below the liquid ejection surface to the outside of the liquid ejection surface through the path and to reduce the amount of mist attached to the liquid ejection surface.

(Fourth Aspect): In the liquid ejection device according to the third aspect, in the ink jet head, the nozzle portions belonging to the same group are arranged at equal intervals in the row direction and the column direction.

In the fourth aspect, for example, when a plurality of nozzle portions are divided into four groups, the nozzle portions which are arranged at an interval of four nozzles in the row direction and are arranged at an interval of four nozzles in the column direction form the same group.

(Fifth Aspect): In the liquid ejection device according to the first aspect, a plurality of nozzles which are arranged in the row direction belong to the same group, and the nozzle portions belonging to the same group are arranged at an interval of equal to or more than two nozzles in the column direction.

According to the fifth aspect, among the nozzle portions belonging to the same group, the nozzle portions which are supplied with the liquid from the same supply flow path are arranged at an interval of two nozzles or more. Therefore, the influence of the crosstalk between the nozzle portions which are supplied with the liquid from the same supply flow path is suppressed.

(Sixth Aspect): In the liquid ejection device according to any one of the first to fifth aspects, when the dummy jet is performed, the driving voltage supply unit supplies a pulsed driving voltage with a frequency of equal to or more than 10 kHz to the plurality of pressurizing elements.

According to the sixth aspect, since the frequency of the driving voltage in the dummy jet is equal to or greater than 10 kHz, the liquid is continuously ejected for a short period. Therefore, a descending air current from the liquid ejection surface is likely to be generated and the probability that mist generated in the vicinity of the liquid ejection surface will be moved in a direction in which it becomes more distant from the liquid ejection surface by the descending air current increases. As a result, it is possible to reduce the amount of mist which moves to the vicinity of the liquid ejection surface.

(Seventh Aspect): In the liquid ejection device according to any one of the first to sixth aspects, when the dummy jet is performed, the driving voltage supply unit supplies, to the plurality of pressurizing elements, a pulsed driving voltage with a frequency equal to the highest ejection frequency during image formation.

According to the seventh aspect, the liquid is continuously ejected for a short period. Therefore, the descending air current from the liquid ejection surface is likely to be generated.

(Eighth Aspect): In the liquid ejection device according to any one of the first to seventh aspects, when the dummy jet is performed, the driving voltage supply unit supplies, to the plurality of pressurizing elements, a pulsed driving voltage with a frequency beyond a frequency range that is affected by crosstalk during the image formation.

According to the eighth aspect, it is possible to suppress the influence of crosstalk. In addition, since liquid ejection in the dummy jet is stabilized, it is possible to suppress the generation of mist.

The frequency range which is affected by crosstalk in image forming is calculated as a frequency range in which an ejection speed is reduced in the relationship between the ejection speed of the liquid and an ejection frequency.

(Ninth Aspect): In the liquid ejection device according to any one of the first to eighth aspects, in the ink jet head, a distance between a liquid ejection surface in which nozzle openings for ejecting the liquid are formed and a landing surface on which the liquid that is ejected by the dummy jet when the dummy jet is performed lands is equal to or greater than 1 mm and equal to or less than 5.4 mm.

In the ninth aspect, it is preferable that the distance between the liquid ejection surface and the landing surface is equal to or less than 3.4 mm.

(Tenth Aspect): In the liquid ejection device according to any one of the first to ninth aspects, in the ink jet head, a liquid ejection surface in which openings of the nozzle portions are formed is provided with a gap portion in which the opening is not formed. The openings formed in the liquid ejection surface are divided into a plurality of blocks by the gap portion. The driving voltage supply unit supplies the ejection driving voltage for preventing the liquid from being ejected to each of the blocks when the dummy jet is performed. During a period of time when the dummy jet is performed for one block, the driving voltage supply unit supplies the non-ejection driving voltage for preventing the liquid from being ejected to the other blocks.

According to the tenth aspect, in the ink jet head in which the openings of the nozzle portions are divided into a plurality of blocks by the gap portion, since the dummy jet is performed for each block, the attachment of mist to the gap portion which divides the nozzle portions into blocks is suppressed.

(Eleventh Aspect): In the liquid ejection device according to the tenth aspect, when the number of groups is an integer p that is equal to or greater than 2 and the number of blocks is an integer q that is equal to or greater than 2, the driving voltage supply unit supplies the driving voltage to each group and each block to perform the dummy jet p×q times.

In the eleventh aspect, when the nozzle portions are divided into four groups and the openings of the nozzle portions are divided into two blocks, liquid ejection is performed eight times in the dummy jet.

(Twelfth Aspect): In the liquid ejection device according to any one of the first to eleventh aspects, the driving voltage supply unit applies, to the pressurizing elements corresponding to nozzle portions belonging to a group for which the dummy jet is not performed, a meniscus micro-vibration voltage which finely vibrates a meniscus of the liquid in the nozzle portions as the non-ejection driving voltage.

According to the twelfth aspect, the drying of the liquid in the nozzle portions belonging to the group for which the dummy jet is not performed and an increase in the viscosity of the liquid are prevented.

(Thirteenth Aspect): There is provided a dummy jet method for a liquid ejection device including an ink jet head in which a plurality of nozzle portions are arranged in a matrix in a row direction and a column direction which obliquely intersects the row direction, a plurality of pressurizing elements that are provided so as to correspond to the plurality of nozzle portions and generate an ejection force for ejecting a liquid from the corresponding nozzle portions, and a driving voltage supply unit that supplies a driving voltage to the plurality of pressurizing elements, the ink jet head being provided with supply flow paths for supplying the liquid to the plurality of nozzle portions, the plurality of nozzle portions which are supplied with the liquid from the same supply flow path being divided into two or more groups. The dummy jet method includes: supplying an ejection driving voltage for ejecting the liquid to each of the groups when a dummy jet is performed; and during a period of time when the dummy jet is performed for one group, supplying a non-ejection driving voltage for preventing the liquid from being ejected to the other groups.

The dummy jet method according to the thirteenth aspect may include a step of setting the number of groups p (p is an integer equal to or greater than 2), a step of setting the number of blocks q (q is an integer equal to or greater than 1), a step of reading masks M(p, q) corresponding to the set number of groups p and the set number of blocks q, and a step of ejecting the liquid from the selected group and block ($G_pB_q$) while switching the masks M(p, q) according to the switching of the groups and the blocks.

The invention described in the specification includes a program that causes a computer to perform the steps described in the thirteenth aspect and the above-mentioned steps and a non-transitory computer readable storage medium storing the program that causes the computer to perform the steps described in the thirteenth aspect and the above-mentioned steps.

EXPLANATION OF REFERENCES

10: ink jet recording device
18: image forming unit
56, 56C, 56M, 56Y, 56K: ink jet head
90: maintenance unit
92: standby cap portion
92A: liquid level
100: system controller
118: image forming control unit
200: head module
203A: first block
203B: second block
203C: gap portion
230: piezoelectric element
277: ink ejection surface
281, 281A, 281B: nozzle portion
300, 302, 304, 306: driving voltage

What is claimed is:

1. A liquid ejection device comprising:

an ink jet head in which a plurality of nozzle portions are arranged in a matrix in a row direction and a column direction which obliquely intersects the row direction;

a plurality of pressurizing elements that are provided so as to correspond to the plurality of nozzle portions and generate an ejection force for ejecting a liquid from the corresponding nozzle portions; and a driving voltage supply unit that supplies a driving voltage to the plurality of pressurizing elements, wherein the ink jet head is provided with supply flow paths for supplying the liquid to the plurality of nozzle portions, the plurality of nozzle portions which are supplied with the liquid from the same supply flow path are divided into two or more groups, the driving voltage supply unit supplies an ejection driving voltage for ejecting the liquid to each of the groups when a dummy jet is performed, and, during a period of time when the dummy jet is performed for one group, supplies a non-ejection driving voltage for preventing the liquid from being ejected to the other groups, wherein, among a plurality of nozzle portions arranged in the column direction, nozzle portions belonging to the same group are arranged such that the group's nozzles are separated from one another by an interval of two or more nozzles.

2. The liquid ejection device according to claim 1, wherein the nozzle portions belonging to the same group are arranged at an interval of equal to or more than two nozzles in the row direction and the column direction.

3. The liquid ejection device according to claim 2, wherein, in the ink jet head, the nozzle portions belonging to the same group are arranged at equal intervals in the row direction and the column direction.

4. The liquid ejection device according to claim 1, wherein, in the ink jet head, the nozzle portions belonging to the same group are arranged at equal intervals in the row direction and the column direction.

5. The liquid ejection device according to claim 1, wherein a plurality of nozzles which are arranged in the row direction belong to the same group, and the nozzle portions belonging to the same group are arranged at an interval of equal to or more than two nozzles in the column direction.

6. The liquid ejection device according to claim 1, wherein, when the dummy jet is performed, the driving voltage supply unit supplies a pulsed driving voltage with a frequency of equal to or more than 10 kHz to the plurality of pressurizing elements.

7. The liquid ejection device according to claim 1, wherein, when the dummy jet is performed, the driving voltage supply unit supplies, to the plurality of pressurizing elements, a pulsed driving voltage with a frequency equal to a highest ejection frequency during image formation.

8. The liquid ejection device according to claim 1, wherein, when the dummy jet is performed, the driving voltage supply unit supplies, to the plurality of pressurizing elements, a pulsed driving voltage with a frequency beyond a frequency range that is affected by crosstalk during image formation.

9. The liquid ejection device according to claim 1, wherein, in the ink jet head, a distance between a liquid ejection surface in which nozzle openings for ejecting the liquid are formed and a landing surface on which the liquid that is ejected by the dummy jet when the dummy jet is performed lands is equal to or greater than 1 mm and equal to or less than 5.4 mm.

10. The liquid ejection device according to claim 1, wherein, in the ink jet head, a liquid ejection surface in which openings of the nozzle portions are formed is provided with a gap portion in which the opening is not formed, the openings formed in the liquid ejection surface are divided into a plurality of blocks by the gap portion, the driving voltage supply unit supplies the ejection driving voltage for ejecting the liquid to each of the blocks when the dummy jet is performed, and, during a period of time when the dummy jet is performed for one block, supplies the non-ejection driving voltage for preventing the liquid from being ejected to the other blocks.

11. The liquid ejection device according to claim 10, wherein, when the number of groups is an integer p that is equal to or greater than 2 and the number of blocks is an integer q that is equal to or greater than 2, the driving voltage supply unit supplies the driving voltage to each group and each block to perform the dummy jet p×q times.

12. The liquid ejection device according to claim 1, wherein the driving voltage supply unit applies, to the pressurizing elements corresponding to nozzle portions belonging to a group for which the dummy jet is not performed, a meniscus micro-vibration voltage which finely vibrates a meniscus of the liquid in the nozzle portions as the non-ejection driving voltage.

13. The liquid ejection device according to claim 1, wherein for the groups for which the dummy jet is performed, ink is ejected from the nozzle portions belonging to the same group at the same time.

14. A dummy jet method for a liquid ejection device including an ink jet head in which a plurality of nozzle portions are arranged in a matrix in a row direction and a column direction which obliquely intersects the row direction, a plurality of pressurizing elements that are provided so as to correspond to the plurality of nozzle portions and generate an ejection force for ejecting a liquid from the corresponding nozzle portions, and a driving voltage supply unit that supplies a driving voltage to the plurality of pressurizing elements, the ink jet head being provided with supply flow paths for supplying the liquid to the plurality of nozzle portions, the plurality of nozzle portions which are supplied with the liquid from the same supply flow path being divided into two or more groups, wherein, among a plurality of nozzle portions arranged in the column direction, nozzle portions belonging to the same group are arranged such that the group's nozzles are separated from one another by an interval of two or more nozzles, the dummy jet method comprising:

supplying an ejection driving voltage for ejecting the liquid to each of the groups when a dummy jet is performed, and during a period of time when the dummy jet is performed for one group, supplying a non-ejection driving voltage for preventing the liquid from being ejected to the other groups.

* * * * *